US007687217B2

(12) United States Patent
Tamagawa et al.

(10) Patent No.: US 7,687,217 B2
(45) Date of Patent: Mar. 30, 2010

(54) IMAGE-RECEIVING SHEET FOR ELECTROPHOTOGRAPHY AND IMAGE FORMING PROCESS

(75) Inventors: Shigehisa Tamagawa, Shizuoka (JP); Ashita Murai, Shizuoka (JP); Shinji Fujimoto, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 576 days.

(21) Appl. No.: 11/641,058

(22) Filed: Dec. 19, 2006

(65) Prior Publication Data

US 2007/0148418 A1 Jun. 28, 2007

(30) Foreign Application Priority Data

Dec. 22, 2005 (JP) ..... 2005-370239

(51) Int. Cl.
*G03G 13/16* (2006.01)

(52) U.S. Cl. ..... 430/124.53; 430/124.5; 428/500; 428/507; 428/511; 428/537.5

(58) Field of Classification Search ..... 430/124.53, 430/124.5; 428/500, 507, 511, 537.5
See application file for complete search history.

(56) References Cited

U.S. PATENT DOCUMENTS 5,658,677 A 8/1997 Ebisch et al.

FOREIGN PATENT DOCUMENTS

JP 08-211645 8/1996
JP 2004-291340 10/2004

*Primary Examiner*—Mark A Chapman
(74) *Attorney, Agent, or Firm*—Sughrue Mion, PLLC

(57) ABSTRACT

The present invention provides an image-receiving sheet for electrophotography which contains a support, and a raw paper, wherein the support contains at least one layer of a polymer coating layer on both surfaces of the raw paper and at least one layer of a toner image-receiving layer on a surface of the support; and the tensile strength in the Z-axis direction of the raw paper defined in the JAPAN TAPPI Paper and Pulp Test Method No. 18-1 is 350 kN/m$^2$ to 650 kN/m$^2$. The present invention also provides an image forming process using the image-receiving sheet for electrophotography.

17 Claims, 3 Drawing Sheets

IMAGE-RECEIVING SHEET FOR ELECTROPHOTOGRAPHY AND IMAGE FORMING PROCESS

BACKGROUND OF THE INVENTION

1. Field of the Invention

The present invention relates to an image-receiving sheet for electrophotography which is excellent in curling properties and conveyability without substantially causing nonuniformity of images, and blisters, and also relates to an image forming process using the image-receiving sheet for electrophotography.

2. Description of the Related Art

Conventionally, as supports for various image recording materials such as image-receiving sheet for electrophotography, heat sensitive materials, inkjet recording materials, sublimation transfer materials, heat developing materials, silver halide materials, and heat transfer materials, for example, raw paper, synthetic paper, synthetic resin sheet, coated paper, laminated paper, and the like are used.

For such an image-receiving sheet for electrophotography, the following image-receiving sheets for electrophotography and the like are proposed. For example, an image bearing material which contains a raw paper, polymer coating layers to be formed on both surfaces of the raw paper, a toner image-receiving layer, and an antistatic layer (see Japanese Patent Application Laid-Open (JP-A) No. 08-211645); and an inkjet recording medium which contains a support, and an ink-receiving layer containing a pigment and a binder, wherein the ink-receiving layer is formed on at least one surface of the support; the tensile strength in the Z-axis direction defined in the JAPAN TAPPI Paper Pulp Test Method No. 18-1 is 700 kN/m$^2$; and the image definition of the ink-receiving layer surface is 50% or more (see Japanese Patent Application Laid-Open UP-A) No. 2004-291340).

Heat resistance is required for the above-noted image-receiving sheets because they are usually subjected to a high-temperature toner fixing step in which the fixing temperature is 110° C. or more. When heat resistance of such an image-receiving sheet is degraded, it may cause problems that blisters easily occur in a resin coating layer. The more the moisture content in raw paper is or the weaker the inter-fiber binding strength is, the easier the blisters occur, which could be a cause of a substantial amount of nonuniformity of images.

Further, in the toner fixing step, an image-receiving sheet is curled by effect of a heating treatment and is conveyed in the curled state. Therefore, it is desired for an image-receiving sheet for electrophotography to have excellent stiffness, dimension stability (curling properties), and conveyability.

However, an image-receiving sheet for electrophotography which is excellent in curling properties and conveyability without substantially causing nonuniformity of images, and blisters has not yet been provided so far, and an image forming process using the image-receiving sheet for electrophotography has not also been provided yet. It is now desired to swiftly provide such an image-receiving sheet for electrophotography and such an image forming process.

SUMMARY OF THE INVENTION

The present invention aims to provide an image-receiving sheet for electrophotography which is excellent in curling properties and conveyability without substantially causing nonuniformity of images, and blisters and an image forming process using the image-receiving sheet for electrophotography.

The image-receiving sheet for electrophotography of the present invention has a support, and at least a toner image-receiving layer disposed on the support, wherein the support has a raw paper and at least one layer of a polymer coating layer on both surfaces of the raw paper; and the tensile strength in the Z-axis direction of the raw paper defined in the JAPAN TAPPI Paper Pulp Test Method No. 18-1 is 350 kN/m$^2$ to 650 kN/m$^2$, and thus the image-receiving sheet excels in curling properties and conveyability without substantially causing nonuniformity of images, and blisters.

The image forming process of the present invention allows for forming high-quality images which are excellent in curling and conveyability without substantially causing nonuniformity of images, and blisters by using the image-receiving sheet for electrophotography of the present invention.

DESCRIPTION OF THE PREFERRED EMBODIMENTS

Image-Receiving Sheet for Electrophotography

Figure 1:
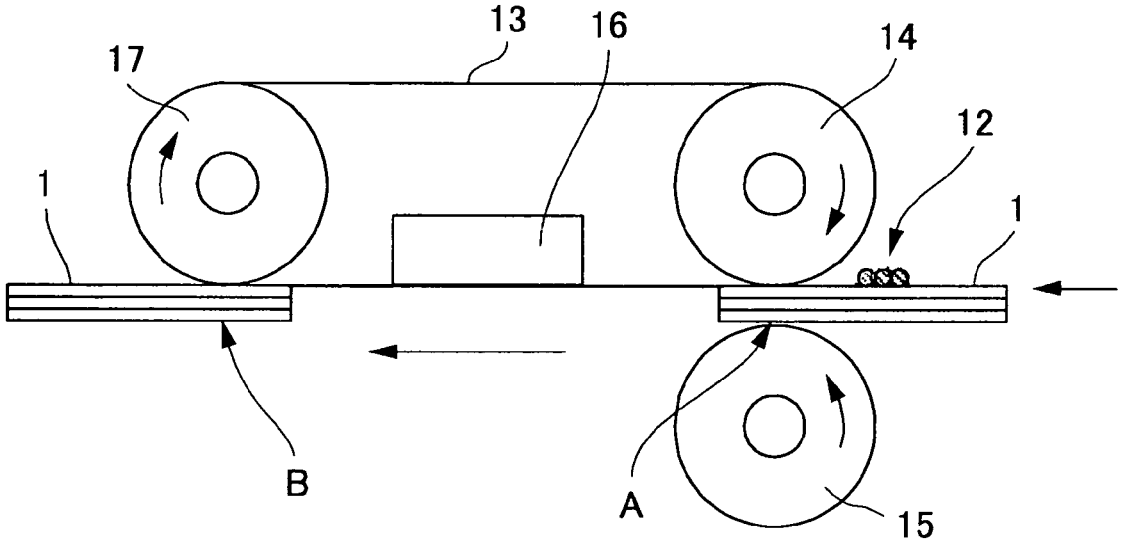
FIG. 1 is a schematic view showing an example of the apparatus configured to fix an image and smooth the image surface according to the present invention.

The image-receiving sheet for electrophotography according to the present invention contains a support, at least a toner image-receiving layer disposed on the support, and optionally other layers suitably selected in accordance with the necessity, such as a surface protective layer, a back layer, an intermediate layer, an undercoating layer, a cushion layer, a charge-controlling (preventing) layer, a reflective layer, a tint-controlling layer, a shelf stability-improving layer, an anti-adhesion layer, an curling layer and a smoothing layer. These layers may be in a single layer structure or a laminate structure of plural layers.

[Support]

The support has a raw paper and at least a one layer of a polymer coating layer on both surfaces of the raw paper.

<Raw Paper>

The raw paper is not particularly limited and may be suitably selected in accordance with the intended use. Preferred specific examples of the raw paper include a woodfree paper, such as a paper described in the literature "Basis of Photographic Technology-silver halide photograph (edited by The Society of Photographic Science and Technology of Japan and published by Corona Publishing Co., Ltd. (1979) (pp. 223-224)"

The raw paper needs to have a tensile strength in the Z-axis direction defined in the JAPAN TAPPI Paper and Pulp Test Method No. 18-1 of 350 kN/m$^2$ to 650 kN/m$^2$, and the tensile strength is preferably 400 kN/m$^2$ to 550 kN/m$^2$ from the perspective of further controlling occurrences of blisters. When the tensile strength in the Z-axis direction is less than 350 kN/m$^2$, blisters seriously occur, which then cause a substantial amount of nonuniformity of images, and degradation in stiffness, curling properties and conveyability. In contrast, when the tensile strength in the Z-axis direction is more than 650 kN/m$^2$, the surface planality of the raw paper may be degraded to thereby easily cause a substantial amount of nonuniformity of images and may affect the conveyability of the image-receiving sheet when being conveyed.

For a method of maintaining the tensile strength in the Z-axis direction within the range defined in the present invention, for example, the degree of water retention which is a degree of swelling of the pulp used as a raw paper, is preferably adjusted to 125% to 155%, and is more preferably adjusted to 130% to 145%.

To maintain the degree of water retention within the above-noted preferred range, for the pulp, it is preferable to use a pulp that has been pulped by a kraft method and then bleached i.e. a kraft pulp (KP).

For the kraft pulp (KP), bleached broad leaf tree kraft pulp (LBKP), and bleached needle-leaf tree kraft pulp (NBKP) can be used, however, the kraft pulp preferably contains a bleached broad leaf tree kraft pulp (LBKP) in an amount of 70% by mass or more.

For beating the pulp, for example, a conical refiner, a disc refiner, a beater, and a Lampen mill can be used. Among them, a conical refiner, and a disc refiner are preferable, and a conical refiner is particularly preferable.

The Canadian Standard Freeness (CSF) of the pulp is preferably 200 mLCSF to 400 mLCSF, and particularly preferable 230 mLCSF to 350 mLCSF.

It is preferable to add a sizing agent, a paper strength additive, a filler, and a fixing agent to a pulp slurry (hereinafter, may be referred to as "pulp stock") which is yielded after beating the pulp.

For the sizing agent, for example, alkyl ketone dimer (AKD), epoxidized fatty acid amide (EFA) are preferable, and a sizing agent in which a behenic acid is used as a fatty acid is particularly preferable.

The added amount of the sizing agent is preferably 0.1 parts by mass to 1.0 part by mass, and particularly preferably 0.2 parts by mass to 0.7 parts by mass relative to 100 parts by mass of the pulp.

Examples of the paper strength additive include cationic starch, polyacrylic amide (PAM), carboxy-modified PVA, gelatin, SBR, and MBR. It is preferable to use a cationic starch in combination with PAM.

The added amount of the paper strength additive is preferably 0.2% by mass to 2.0% by mass.

Examples of the filler include $TiO_2$, $CaCO_3$, clay, and talc. $TiO_2$ and $CaCO_3$ are preferable, and $TiO_2$ is particularly preferable.

The added amount of the filler is preferably 1 part by mass to 30 parts by mass, and particularly preferably 3 parts by mass to 10 parts by mass relative to 100 parts by mass of the pulp.

For the fixing agent, it is preferable to add a carboxy methyl cellulose sodium (CMC), and particularly preferable to add a water-swelling powder of carboxy methyl cellulose.

The added amount of the fixing agent is preferably 0.5 parts by mass to 5 parts by mass relative to 100 parts by mass of the pulp.

The moisture content of the raw paper is not particularly limited, however, it is preferably 4% by mass to 7.5% by mass. When the moisture content is less than 4% by mass, static electricity easily occurs, which may affect the conveyability of the image-receiving sheet when being conveyed. When the moisture content is more than 7.5% by mass, the threshold temperature of blisters may be lowered to cause blisters at lower temperatures.

Here, the moisture content can be determined, for example, by the method described in JIS P 8127 (by means of a drier).

For smoothing the surface of the raw paper, it is preferred that the raw paper is produced, as described in JP-A No. 58-68037, using a pulp fiber having a fiber length distribution in which a total of a 24 mesh screen remnant and a 42 mesh screen remnant is from 20% by mass to 45% by mass and a 24 mesh screen remnant is 5% by mass or less, based on the mass of all pulp fibers. Moreover, the mean center line roughness of the raw paper can be controlled by subjecting the raw paper to a surface treatment by applying the heat and pressure using a machine calendar or a super calendar.

To the pulp stock, for example, a softening agent, a pH adjustor, a pitch controlling agent, a slime controlling agent, and other agents are further added in accordance with the necessity.

—Softening Agent—

The softening agent is not particularly limited and may be suitably selected from among those known in the art, however, preferred examples thereof are flexibilizer, and bulking agents.

The softening agent is not particularly limited and may be suitably selected in accordance with the intended use, and preferred examples thereof include fatty acid-containing compounds.

The number of carbon atoms in the fatty acid-containing compound is not particularly limited and may be suitably selected in accordance with the intended use, however, it is preferably 10 to 30.

Preferred examples of the fatty acid-containing compound include epoxidized fatty acid amide, fatty acid diamide salt, alkylene oxide adducts of fatty acid esters, and quaternary ammonium salts of fatty acids. Each of these fatty acid-containing compounds may be used alone or in combination with two or more.

Examples of the epoxidized fatty acid amide include compounds represented by the following Structural Formula (1). Each of these compounds may be used alone or in combination with two or more.

Structural Formula (1)

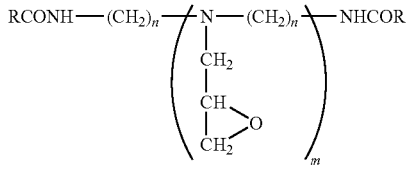

In Structural Formula (1), "R" represents an alkyl group or an alkenyl group, or any one of these groups may be substituted by a substituent group; and "n" and "m" are respectively an integer.

Examples of the fatty acid diamide salt include compounds represented by the following Structural Formula (2). In Structural Formula (2), "R" is particularly preferably an oleic acid diamide salt.

Structural Formula (2)

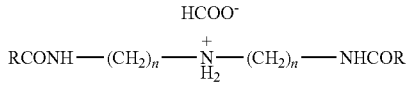

In Structural Formula (2), "R" represents an alkyl group or an alkenyl group, or any one of these groups may be substituted by a substituent group; and "n" is an integer.

Examples of the alkylene oxide adducts of fatty acid esters include compounds of which an alkylene oxide is added to oil or fat. Each of these may be used alone or in combination with two or more.

Examples of the oil or fat include land-product animal oils, marine-product animal oils, hardened oils thereof, semi-hardened oils thereof, and recovered oils that can be obtained in refining step of these oils and fats. Specific examples thereof include coconut oils, beef fats, fish oils, linseed oils, seed oils, and castor oils.

Preferred examples of the alkylene oxide include ethylene oxides, and propylene oxides.

The number of added moles of the alkylene oxide is not particularly limited and may be suitably selected in accordance with the intended use. For example, it is preferably 0 to 20, and more particularly 2 to 10.

In the present invention, an alkylene oxide can be added to a mixture between a refined product obtained by reacting the oil or fat with glycerine beforehand and a primary to 14-valent polyvalent alcohol for use.

For the primary alcohol, straight chain or branched chain and saturated or unsaturated alcohols having 1 to 24 carbon atoms, and cyclic alcohols, and straight chain or branched chain saturated alcohols having 4 to 12 carbon atoms are preferable. Examples of the divalent alcohols include α,ω-glycols having 2 to 32 carbon atoms, 1,2 diols having 2 to 32 carbon atoms, symmetry α-glycols, and cyclic 1,2-diols, and α,ω-glycols having 2 to 6 carbon atoms are preferable. Examples of the trivalent or more alcohols include glycerines, diglycerines, sorbitols, and stachyoses each having 3 to 24 carbon atoms. For the alcohol, divalent to hexavalent alcohols having 2 to 6 carbon atoms are particularly preferable.

Examples of the quaternary ammonium salts of fatty acids include compounds represented by the following Structural Formula (3). Specific examples thereof include di-hardened beef fat dimethyl ammonium chloride, dipalmitoyl dimethyl ammonium chloride, bis(β-hydroxy stearyl)diethyl ammonium chloride, di-hardened palm oil dimethyl ammonium chloride, and distearyl dimethyl ammonium chloride. Each of these quaternary ammonium salts of fatty acids may be used alone or in combination with two or more.

Structural Formula (3)

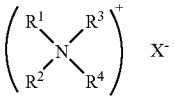

In Structural Formula (3), $R^1$ and $R^2$ respectively represent an alkyl group, an alkenyl group, or a hydroxy alkyl group having 10 to 24 carbon atoms; $R^3$ and $R^4$ respectively represent an alkyl group, a hydroxy alkyl group, a benzyl group, or $—(C_2H_{40})_n—$ each having 1 to 3 carbon atoms; and X represents halogen atom, or a monoalkyl sulfate group having 1 to 3 carbon atoms.

The content of the softening agent in the surface is preferably 0.4 parts by mass or more, preferably 0.4 parts by mass to 1.5 parts by mass, and more preferably 0.6 parts by mass to 1.2 parts by mass relative to 100 parts by mass of the pulp.

When the content is less than 0.4 parts, the surface planality of the support for image recording material is sometimes insufficient.

A layer on which an image recording layer is to be formed preferably meets the requirement of the content of the softening agent.

The content of the softening agent in the center part is not particularly limited and may be suitably selected in accordance with the intended use, however, it is preferably 0.2 parts by mass or less, more preferably 0.1 parts by mass or less, and particularly preferably 0 parts by mass relative to 100 parts by mass of the pulp.

When the content of the softening agent is more than 0.1 parts by mass, the stiffness of the support for image recording material may be insufficient.

The center part means a depth of ⅓ to ⅔ of at least one surface of the raw paper in the thickness direction.

The content of the softening agent means the total content of a content of the softening agent which is reactive to the pulp and a content of the softening agent which is unreactive to the pulp, and when an epoxidized fatty acid amide is used as the softening agent, the content of the softening agent can be determined by the following method.

Specifically, 10 g of each sample is taken from the surface part and the center part. First, to extract an epoxidized fatty acid amide that is unreactive to the pulp (1), the sample is dry-distilled in n-butanol heated at 130° C., and thereafter, 2.4 defined hydrochloric acid is added to the n-butanol extract, and the temperature of the extract is maintained at 130° C. for 6 hours to subject the extract to a hydrolysis-n-butyl esterification treatment. The esterified extract is extracted twice with 50 mL of chloroform and then dried with 20 g of sodium sulfate and then subjected to a gas chromatographic determination (column: DB-FFAP), thereby the content of the epoxidized fatty acid amide which is unreactive to the pulp can be quantitated. To extract an epoxidized fatty acid amide which is reactive to the pulp (2), hydrochloric acid of 10% concentration is added to the n-butanol extract, and the temperature of the extract is maintained at 130° C. for 6 hours to subject the extract to a hydrolysis-n-butyl esterification treatment. The esterified extract is extracted twice with 50 mL of chloroform and then dried with 20 g of sodium sulfate and then subjected to a gas chromatographic determination (column: DB-FFAP), thereby the content of the epoxidized fatty acid amide which is reactive to the pulp can be quantitated. The values each quantitated in (1) and (2) are summed, thereby the content the epoxidized fatty acid amide can be quantitated.

Examples of the pH adjustor include caustic soda, and sodium carbonate.

Examples of the other agents include an antifoaming agent, a dye, a slime controlling agent, and a fluorescent whitening agent.

In accordance with the necessity, the pulp slurry may contain a flexibilizer. Examples of the flexibilizer include agents described in the literature "Paper and Paper Treatment Manual (published by Shiyaku Time Co., Ltd. (1980) (pp. 554-555)).

Each of these agents may be used alone or in combination with two or more.

The pulp paper material which is optionally prepared by incorporating the various additives into the pulp slurry is subjected to the papermaking using a paper machine, such as a manual paper machine, a Fourdrinier (long-net) paper machine, a round-net paper machine, a twin-wire machine and a combination machine, and the made paper is dried to produce the raw paper. If desired, either before or after the drying of the made paper, the made paper may be subjected to the surface sizing treatment.

The treating liquid used for the surface sizing treatment is not limited and may be suitably selected in accordance with the intended use. Examples of the compound contained in the treating liquid include a water-soluble polymer, a waterproof compound, a pigment, a dye and a fluorescent whitening agent.

Examples of the water-soluble polymer include a cationic starch, an oxidized starch, a polyvinyl alcohol, a carboxy-modified polyvinyl alcohol, a carboxymethylcellulose, a hydroxyethylcellulose, a cellulose sulfate, gelatin, casein, a sodium polyacrylate, a sodium salt of styrene-maleic anhydride copolymer and a sodium salt of polystyrene sulfonic acid.

Examples of the waterproof compound include latexes and emulsions, such as a styrene-butadiene copolymer, an ethylene-vinyl acetate copolymer, a polyethylene and a vinylidene chloride copolymer; a polyamidepolyamineepichlorohydrin, and synthetic waxes.

Examples of the pigment include calcium carbonate, clay, kaolin, talc, barium sulfate and titanium oxide.

From the viewpoint of improving curling properties of the raw paper, it is preferred that the raw paper has the ratio (Ea/Eb) between the longitudinal Young's modulus (Ea) and the lateral Young's modulus (Eb) of from 1.5 to 2.0. When the ratio (Ea/Eb) is less than 1.5 or more than 2.0, the stiffness and the curling properties of the image-receiving sheet for electrophotography may be easily impaired, and then a disadvantage is caused wherein the conveyability of the image-receiving sheet for electrophotography is hindered.

Generally, it has been clarified that the "nerve" of the paper is varied depending on the method for beating the pulp and as an important index indicating the "nerve" of the paper, the modulus of elasticity of the paper made by the papermaking after the beating of the pulp, can be used. The modulus of elasticity of the paper can be calculated according to the following equation:

$$E=\rho c^2(1-n^2)$$

where "E" represents dynamic modulus, "ρ" represents the density of the paper, "c" represents the velocity of sound in the paper, and "n" represents the Poisson's ratio, by using the relation between the dynamic modulus of the paper indicating the properties as a viscoelastic body and the density of the paper, and the velocity of sound in the paper measured using an ultrasonic oscillator.

In addition, since n=0.2 or so with respect to an ordinary paper, there is not much difference between the calculation of the dynamic modulus according to the above-noted equation and the calculation according to the following equation:

$$E=\rho c^2.$$

Accordingly, when the density of the paper and the velocity of sound in the paper can be measured, the elastic modulus of the paper can be easily calculated. For measuring the velocity of sound in the paper, various conventional instruments such as a SONIC TESTER SST-110 (manufactured and sold by Nomura Shoji Co., Ltd.) can be used.

The thickness of the raw paper is not particularly limited and may be suitably selected in accordance with the intended use, however, it is preferably 30 μm to 500 μm, more preferably 50 μm to 300 μm, and still more preferably 100 μm to 250 μm. The basis weight is not particularly limited and may be suitably selected in accordance with the intended use, however, it is preferably 50 g/m$^2$ to 250 g/m$^2$, and more preferably 100 g/m$^2$ to 200 g/m$^2$.

The method of drying the paper is not particularly limited and may be suitably selected in accordance with the intended use, and examples thereof include a drying treatment using a pressing machine, a drying treatment using a casting drum, and a drying treatment using a cylinder.

The raw paper is preferably subjected to the drying treatment and then subjected to a calender treatment such that metal rollers make contact with a surface of the raw paper with an image to be recorded thereon.

The surface temperature of the metal rollers is preferably 100° C. or more, more preferably 150° C. or more, and still more preferably 200° C. or more. The upper limit surface temperature of the metal rollers is not particularly limited and may be suitably selected in accordance with the intended use, for example, 300° C. or so is preferable.

The nip pressure employed in the calender treatment is not particularly limited and may be suitably selected in accordance with the intended use, however, it is preferably 100 kN/cm$^2$ or more, and more preferably 100 kN/cm$^2$ to 600 kN/cm$^2$.

A calender used in the calender treatment is not particularly limited and may be suitably selected in accordance with the intended use, and preferred examples of thereof include a soft calender roller containing a combination of a metal roller and a synthetic resin roller, and a machine calender roller containing a pair of metal rollers. Of these, a calender having a soft calender roller is preferable. In particular, a long nip shoe calender which contains a shoe roller arranged via a metal roller and a synthetic resin belt is preferably used because it can take a long nip width and allows for increasing the contact area between a cast coat layer of the raw paper and the roller.

<Polymer Coating Layer>

At least one layer of the polymer coating layer is formed to both surfaces of the raw paper.

It is preferable that at least two layers of right face polyolefin resin layers are formed on a surface of the polymer coating layer on which a toner image-receiving layer is to be formed, and the at least two layers of right face polyolefin resin layers are an outermost right face polymer coating layer which is disposed at the farthest from the raw paper, and a right face polymer coating layer other than the outermost right face polymer coating layer.

When the right face polymer coating layer has a two-layered laminate structure where an under polymer coating layer and a upper polymer coating layer are formed in this order on the raw paper, the upper polymer coating layer serves as the outermost right face polymer coating layer, and the under polymer coating layer serves as the right face polymer coating layer other than the outermost right face polymer coating layer.

When the right face polymer coating layer has a three-layered laminate structure where an under polymer coating layer, an intermediate polymer coating layer, and an upper polymer coating layer are formed in this order on the raw paper, the upper polymer coating layer serves as the outermost right face polymer coating layer, and the under polymer coating layer and the intermediate polymer coating layer serve as the right face polymer coating layer other than the outermost right face polymer coating layer.

In the present invention, it is preferable that the melting point of a polymer contained in the innermost right face polymer coating layer which is disposed at the nearest from the raw paper is 15° C. or more higher than the melting point of a polymer contained in the outermost right face polymer coating layer which is located at the farthest from the raw paper, and is 130° C. or more. When the melting point of a polymer contained in the innermost right face polymer coating layer which is located at the closest of the raw paper is not 15° C. or more higher than the melting point of a polymer contained in the outermost right face polymer coating layer which is located at the farthest from the raw paper, and/or is less than 130° C., the threshold temperature of blisters may be lowered to cause blisters at lower temperatures, and nonuniformity of images may easily occur.

The thickness of at least any one of the right face polyolefin resin layers other than the outermost right face polymer coating layer is preferably 5 μm or more, and more preferably 7 μm to 20 μm.

The thickness of the outermost right face polyolefin resin layer is preferably 5 μm or more, and more preferably 7 μm to 20 μm.

The thickness of a back face polyolefin resin layer is not particularly limited and may be suitably selected in accordance with the intended use, however, from the viewpoint of curl-balancing, it is preferable to suitably adjust the thickness of the back face polyolefin resin layer such that finally curled form thereof appears flat.

A resin constituting the polymer coating layer is not particularly limited and may be suitably selected in accordance with the intended use, however, preferred examples thereof are polyolefin resins.

Examples of the polyolefin resins include polyethylene, polypropylene, blended compounds between a polypropylene and a polyethylene, high-density polyethylene, and blended compounds between a high-density polyethylene and a low-density polyethylene.

In particular, the back face polymer coating layer to be formed on the surface of the support on which the toner image-receiving layer is not to be formed is preferably made from a polyolefin resin containing a high-density polyethylene having a density of 0.945 g/cm$^3$ or more. When the back face polymer coating layer does not contain a high-density polyethylene, curling properties may be degraded.

The mass ratio between the high-density polyethylene and resins other than the polyolefin resin contained in the back face polymer coating layer is preferably 1/1, more preferably 2/1, and particularly preferably all the components of the polyolefin resin is the high-density polyethylene. The upper limit of the average density of the polyolefin resin is 0.970 g/cm$^3$.

It is preferable that at least any one of the right face and the back face of the polymer coating layer contains either an organic pigment or an inorganic pigment.

Examples of the organic pigment include ultramarine, Silurian blue, phthalocyanine blue, cobalt violet, fast violet, and manganese violet.

Examples of the inorganic pigment include titanium dioxide, calcium carbonate, talc, stearic acid amide, and zinc stearate.

Of these, titanium dioxide is preferable. The titanium dioxide may be any one of an anatase titanium dioxide and a rutile titanium dioxide. The content of the titanium dioxide in the polyolefin resin layer is preferably 5% by mass to 30% by mass.

The method for forming the polymer coating layer is not particularly limited and may be suitably selected in accordance with the intended use. The polymer coating layer can be formed, typically, by a laminate method, a sequential laminate method or a laminating method using single-layer extrusion dies or multi-layer extrusion dies such as feet block die, multi manifold die, and multi slot dies or a laminator, or a co-extrusion coating method in which a resin is extruded in a multi-layered way at the same time for coating. The shape of the single-layer extrusion dies or multi-layer extrusion dies is not particularly limited and may be suitably selected in accordance with the intended use. Preferred examples thereof include T-dies, coat hanger dies.

[Toner Image-Receiving Layer]

The toner image-receiving layer is formed to receive color toners and a black toner and form an image using the toners. The toner image-receiving layer has functions to receive a toner forming an image from a developing drum or an intermediate transfer member by effect of (static) charge, and/or pressure, or the like in a image-transferring step, and to solidify the image by effect of heat and/or pressure, and the like in a fixing step.

From the perspective of making an electrophotographic material of the present invention have a texture close to a photograph, the toner image-receiving layer preferably has low transparency of a light transmittance of 78% or less. The light transmittance of the toner image-receiving layer is more preferably 73% or less, and still more preferably 72% or less.

The light transmittance of the toner image-receiving layer can be measured by forming a coating layer having a thickness of 100 μm on the polyethylene terephthalate film having a thickness of 100 μm, and measuring the light transmittance of the coating layer using a direct reading haze meter (HGM-2DP, manufactured by Suga Tester Co., Ltd.).

The toner-image receiving layer contains at least a thermoplastic resin and further contains various additives, where necessary, that could be added for improving thermodynamic properties of the toner image-receiving layer such as a releasing agent, a plasticizer, a coloring agent, a filler, a crosslinking agent, a charge adjusting agent, an emulsifier, and a dispersing agent.

—Thermoplastic Resin—

The resin with which the surface of the raw paper is coated is not particularly limited and may be suitably selected in accordance with the intended use. The resin is preferably a thermoplastic resin. Examples of the thermoplastic resin include (1) polyolefin resins, (2) polystyrene resins, (3) acrylic resins, (4) a polyvinyl acetate and derivatives thereof, (5) polyamide resins, (6) a polyester resin, (7) a polycarbonate resin, (8) a polyether resin (or an acetal resin), and (9) other resins. Each of these thermoplastic resins may be used alone or in combination with two or more. Of these, styrene resins, acrylic resins, polyester resins each having a large amount of cohesive energy are preferably used from the perspective of embedding of a toner in the resin.

Examples of the polyolefin resins (1) include a polyolefin resin, such as a polyethylene and a polypropylene; and a copolymer resin produced by copolymerizing an olefin, such as ethylene and propylene with another vinyl monomer. Examples of such a copolymer resin (produced by copolymerizing an olefin with another vinyl monomer) include an ethylene-vinyl acetate copolymer and an ionomer resin which is produced by copolymerizing an olefin with acrylic acid or methacrylic acid. Examples of the derivatives of the polyolefin resins include a chlorinated polyethylene and a chlorosulfonated polyethylene.

Examples of the polystyrene resins (2) include a polystyrene resin, a styrene-isobutylene copolymer, an acrylonitrile-styrene copolymer (AS resin), an acrylonitrile-butadiene-styrene copolymer (ABS resin) and a polystyrene-maleic anhydride resin.

Examples of the acrylic resins (3) include a polyacrylic acid and esters thereof, a polymethacrylic acid and esters thereof, a polyacrylonitrile and a polyacrylamide.

Examples of the esters of polyacrylic acid include homopolymers and copolymers of esters of acrylic acids. Examples of the esters of acrylic acids include methyl acrylate, ethyl acrylate, n-butyl acrylate, isobutyl acrylate, dodecyl acrylate, n-octyl acrylate, 2-ethylhexyl acrylate, 2-chlorethyl acrylate, phenyl acrylate, and α-chlormethyl acrylate.

Examples of the esters of polymethacrylic acids include homopolymers and copolymers of esters of methacrylic acids. Examples of the esters of methacrylic acid include methyl methacrylate, ethyl methacrylate, and butyl methacrylate.

Examples of the polyvinyl acetate and derivatives thereof (4) include a polyvinyl acetate, a polyvinyl alcohol produced by saponifying the polyvinyl acetate and a polyvinylacetal resin produced by reacting the polyvinyl alcohol with an aldehyde (e.g., formaldehyde, acetaldehyde and butyraldehyde).

The polyamide resins (5) are polycondensates of a diamine and a dibasic acid and examples thereof include 6-nylon and 6,6-nylon.

The polyester resin (6) is produced by a polycondensation between an acid component and an alcohol component. The acid component is not particularly limited and may be suitably selected in accordance with the intended use, and examples thereof include maleic acids, fumaric acid, citraconic acid, itaconic acid, gulutaconic acid, phthalic acid, terephthalic acid, isophthalic acid, succinic acid, adipic acid, sebacic acid, azelaic acid, malonic acid, n-dodecenylsuccinic acid, isododecenylsuccinic acid, n-dodecenylsuccinic acid, isododecenylsuccinic acid, n-octenylsuccinic acid, n-octenylsuccinic acid, isooctenylsuccinic acid, isooctenylsuccinic acid, trimellitic acid, and pyromellitic acid; and acid anhydrides thereof or lower alkyl esters thereof.

The alcohol component is not particularly limited and may be suitably selected in accordance with the intended use. For example, a divalent alcohol is preferable.

Preferred examples of the divalent alcohol include aliphatic diols. Examples of the aliphatic diols include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, propylene glycol, and polytetramethylene glycol.

The polyester resin may contain an alkylene oxide adduct of bisphenol A. Examples of the alkylene oxide adduct of bisphenol A include polyoxyproplylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis (4-hydroxyphenyl)propane.

General examples of the polycarbonate resin (7) include a polycarbonate ester produced from bisphenol A and phosgene.

Examples of the polyether resin (or the acetal resin) (8) include a polyether resin, such as a polyethylene oxide and a polypropylene oxide (or an acetal resin produced by a ring opening polymerization, such as a polyoxymethylene).

The other resins (9) include a polyurethane resin produced by an addition polymerization.

For the thermoplastic resin, a thermoplastic resin capable of satisfying physical properties of the toner image-receiving layer, which will be hereinafter described, in a state where the toner image-receiving layer is formed thereon is preferably used, a thermoplastic resin capable of satisfying the physical properties of the toner image-receiving layer even with the use of the resin alone is more preferably used. It is also preferable to use two or more different resins which are different in the physical properties of the toner image-receiving layer.

For the thermoplastic resin, a thermoplastic resin having a molecular mass greater than that of the thermoplastic resin used in the toner is preferable. However, the relation of the molecular mass is not necessarily preferable depending on the relation of thermodynamic properties of the thermoplastic resin used in the toner and the thermoplastic resin used in the toner image-receiving layer. For example, when the softening temperature of the thermoplastic resin in the toner image-receiving layer is higher than that of the thermoplastic resin used in the toner, there may be cases where it is preferable that the molecular mass of the thermoplastic resin used in the toner image-receiving layer is equal to that of the thermoplastic resin used in the toner, or the molecular mass of the thermoplastic resin used in the toner image-receiving layer is smaller than that of the thermoplastic resin used in the toner.

As a thermoplastic resin to be used in the toner image-receiving layer, it is preferable to use a mixture of resins which have the same composition and differ in the average molecular mass from each other. For the relation of molecular mass of the thermoplastic resin used in the toner, a relation disclosed in Japanese Patent Application Laid-Open (JP-A) No. 08-334915 is preferable.

The molecular mass distribution of the thermoplastic resin used in the toner image-receiving layer is preferably wider than that of the thermoplastic resin used in the toner.

It is preferable that the thermoplastic resin to be used in the toner image-receiving layer satisfies physical properties disclosed in Japanese Patent Application Laid-Open (JP-A) Nos. 05-127413, 08-194394, 08-334915, 08-334916, 09-171265, and 10-221877.

For a thermoplastic resin used for the toner image-receiving layer, (1) it causes no discharge of organic solvents in coating and drying step and is excellent in environmental suitability, and working suitability. An aqueous resin such as a water dispersible polymer and a water-soluble polymer is suitably used for the following reasons. (ii) Many of releasing agents such as waxes are hardly insoluble in a solvent at room temperature, and in many cases, a releasing agent is dispersed in a solvent (water, organic solvent) beforehand for use. A releasing agent in a water dispersion form is more excellent in stability and production step suitability. Further, in an aqueous coating treatment, a wax more easily bleeds out to the surface in the course of coating and drying the surface, and then effects of the releasing agent such as antioffset properties and adhesion resistance can be readily obtained.

The aqueous resin is not particularly limited as to the composition, binding structure, molecular structure, molecular mass, molecular mass distribution, form, etc., and may be suitably selected in accordance with the intended use. Examples of hydrated groups of the polymer include sulfonic groups, hydroxyl groups, carboxylic groups, amino groups, amide groups, and ether groups.

For the water dispersible polymer, two or more water dispersible polymers can be selected from resins or emulsions prepared by dispersing any one of the thermoplastic resins (1) to (9) in water, copolymers thereof, mixtures thereof, and cation-modified products, in combination.

For the water dispersible polymer, a suitably synthesized one may be used, or a commercially available product may be used. Examples of the commercially available product include water dispersible polyester polymers such as BYRONAL series manufactured by TOYOBO Co., Ltd., PESRESIN A series manufactured by Takamatsu Oil & Fat Co., Ltd., TAFTON® UE series manufactured by KAO Corporation, POLYESTER WR series manufactured by Nippon Synthetic Chemical Industry Co., Ltd., and ELIETEL series manufactured by UNITIKA Ltd.; and water dispersible acrylic resins such as HIROS XE, KE, and PE series manufactured by SEIKO PMC CORPORATION, and JULIMER ET series manufactured by Nihon Junyaku Co., Ltd.

The water dispersible emulsion is not particularly limited and may be suitably selected in accordance with the intended use. Examples thereof include water dispersible polyurethane emulsions, water dispersible polyether emulsions, chloroprene emulsions, styrene-butadiene emulsions, nitrile-butadiene emulsions, butadiene emulsions, butadiene emulsions, vinylchloride emulsions, vinylpyridine-styrene-butadiene emulsions, polybutene emulsions, polyethylene emulsions, vinylacetate emulsions, ethylene-vinylacetate emulsions, vinylidene chloride emulsions, and methyl methacrylate-butadiene emulsions. Of these, water dispersible polyester emulsions are particularly preferable.

The water dispersible polyester emulsion is preferably a self-dispersible water polyester emulsion. Of these, a carboxyl group-containing self-dispersible aqueous polyester emulsion is particularly preferable. Here, the self-dispersible aqueous polyester emulsion means an aqueous emulsion containing a polyester resin which is self-dispersible in an aqueous solvent. The carboxyl group-containing self-dispersible aqueous polyester resin emulsion means an aqueous emulsion containing a polyester resin which contains a carboxyl group as a hydrophilic group and is self-dispersible in an aqueous solvent.

For the self-water dispersible polyester emulsion, the one that can meet the following characteristics (1) to (4) is preferable. The self-water dispersible polyester emulsion is a self-dispersible polyester emulsion prepared without using a surfactant, and thus it has low-hygroscopicity under high-humidity atmosphere, less cause decreases in softening point attributable to moisture, and can prevent offset occurrences in fixing step and occurrences of inter-sheet adhesion troubles when stored. In addition, a self-water dispersible polyester emulsion is excellent in environmental properties, and workability. Further, a polyester resin that can easily take a molecular structure having a high-cohesive energy is used therein, a self-water dispersible polyester emulsion is in a low-viscosity molten state in a fixing step of electrophotography but has a sufficient hardness in storage environment, and a toner or toners can be embedded in the image-receiving layer, thereby a sufficient high-quality image can be obtained.

(1) The number average molecular mass (Mn) of the self-water dispersible polyester emulsion is preferably 5,000 to 10,000, and more preferably 5,000 to 7,000.

(2) The molecular mass distribution (weight average molecular mass/number average molecular mass) or (Mw/Mn) of the self-water dispersible polyester emulsion is preferably 4 or less, and more preferably 3 or less.

(3) The glass transition temperature (Tg) of the self-water dispersible polyester emulsion is preferably 40° C. to 100° C., and more preferably 50° C. to 80° C.

(4) The volume average particle diameter of the self-water dispersible polyester emulsion is preferably 20 nm to 200 nm, and more preferably 40 nm to 150 mm.

The content of the water-dispersible emulsion in the toner image-receiving layer is preferably 10% by mass to 90% by mass, more preferably 10% by mass to 70% by mass.

The water-soluble polymer is not particularly limited and may be suitably selected in accordance with the intended use as long as the mass average molecular mass (Mw) is 400,000 or less, and a suitably synthesized water-soluble polyester may be used, or a commercially available product may be used. Examples of the water-soluble polymer include polyvinyl alcohol, carboxy-modified polyvinyl alcohol, carboxy methyl cellulose, hydroxy ethyl cellulose, cellulose sulfate, polyethylene oxide, gelatin, cationic starch, casein, sodium polyacrylate, sodium of styrene-maleic acid anhydride copolymer, and sodium styrenesulfonate. Of these, polyethylene oxide is preferable.

Examples of commercially available products of the water soluble polymer include water soluble polyesters such as various plus coats manufactured by Gao Chemical Industries, FINETEX ES series manufactured by Dainippon Ink and Chemicals, Inc.; and water soluble acryls such as JULIMER AT series manufactured by Nihon Junyaku Co., Ltd., FINTEX 6161, K-96 manufactured by Dainippon Ink and Chemicals, Inc., and HIROS NL-1189 and BH-997L manufactured by SEIKO PMC CORPORATION.

In addition, examples of the water soluble polymer include those described on page 26 No. 643 Research Disclosure No. 17,643, on page 651 Research Disclosure No. 18,716, on pp. 873-874 Research Disclosure No. 307,105, and Japanese Patent Application Laid-Open (JP-A) No. 64-13546.

The content of the water soluble polymer in the toner image-receiving layer is not particularly limited and may be suitably selected in accordance with the intended use, however, it is preferably 0.5 g/m$^2$ to 2 g/m$^2$.

The thermoplastic resin can be used in combination with other polymer materials, however, in such a case, typically, the thermoplastic resin is used in a higher content than that of the other polymer materials.

The content of the thermoplastic resin for the toner-image receiving layer in the toner image-receiving layer is preferably 10% by mass or more, more preferably 30% by mass or more, still more preferably 50% by mass or more, and particularly preferably 50% by mass to 90% by mass.

—Releasing Agent—

The releasing agent is blended to materials of the toner image-receiving layer to prevent offset of the toner image-receiving layer. The releasing agent used in the present invention is not particularly limited and may be suitably selected in accordance with the intended use as long as it is heated and melted at the fixing temperature to precipitate on the surface of the toner image-receiving layer and unevenly exist on the surface of the toner image-receiving layer, and then it is cooled and solidified, thereby a layer of releasing agent materials can be formed on the surface of the toner image-receiving layer.

Examples of the releasing agent are at least one selected from silicone compounds, fluorine compounds, waxes, and matting agents.

For the releasing agent, for example, any one of compounds described in "Properties and Applications of Waxes —Revised edition" published by Saiwai Shobo, and compounds described in "Handbook of Silicones" issued by NIKKAN KOGYO SHIMBUN, LTD. can be used. It is also possible to preferably use any one of silicone compounds, fluorine compound, and waxes used for toners described in Japanese Patent (JP-B) Nos. 2838498, and 2949585, and Japanese Patent Application Laid-Open (JP-A) Nos. 59-38581, 04-32380, 50-117433, 52-52640, 5757-148755, 61-62056, 61-62057, 61-118760, 02-42451, 03-41465, 04-212175, 04-214570, 04-263267, 05-34966, 05-119514, 06-59502, 06-161150, 06-175396, 06-219040, 06-230600, 06-295093, 07-36210, 07-36210, 07-43940, 07-56387, 07-56390, 07-64335, 07-199681, 07-223362, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049, and 11-194542. Each of these compounds may be used alone or in combination with two or more.

Examples of the silicone compounds include silicone oils, silicone rubbers, silicone fine particles, silicone-modified resins, and reactive silicone compounds.

Examples of the silicone oils include unmodified silicone oil, amino-modified silicone oils, carboxy-modified silicone oils, carbinol-modified silicone oils, vinyl-modified silicone oils, epoxy-modified silicone oils, polyether-modified silicone oils, silanol-modified silicone oils, methacryl-modified silicone oils, mercapto-modified silicone oils, alcohol-modified silicone oils, alkyl-modified silicone oils, and fluorine-modified silicone oils.

Examples of the silicone-modified resins include olefin resin, polyester resin, vinyl resin, polyamide resin, cellulose resin, phenoxy resin, vinylchloride-vinylacetate resin, urethane resin, acrylic resin, styrene-acryl resin, or resins obtained by modifying the each of the copolymer resins thereof with silicone.

The fluorine compound is not particularly limited and may be suitably selected in accordance with the intended use, and examples thereof include fluorine oils, fluorine rubbers, fluorine-modified resins, fluorine sulfonate compounds, fluorosulfonate, fluorine acid compounds or salts thereof, and inorganic fluorides.

The waxes are broadly divided into natural waxes and synthetic waxes. For the natural waxes, at least one selected from vegetable waxes, animal waxes, mineral waxes, and petroleum waxes is preferable. Of these, vegetable waxes are particularly preferable. For the natural wax, a water-dispersible wax is particularly preferable in terms of compatibility in the case where an aqueous resin is used as a polymer for the toner image-receiving layer.

The vegetable wax is not particularly limited and may be suitably selected from among those known in the art, and it may be a commercially available product, or may be a suitably synthesized one. Examples of the vegetable wax include carnauba wax, castor oil, rapeseed oil, soybean oil, vegetable tallow, cotton wax, rice wax, sugarcane wax, candelilla wax, Japan wax, and jojoba wax.

Examples commercially available products of the carnauba wax include EMUSTAR-0413 manufactured by NIPPON SEIRO CO., LTD., CELLOZOL 524 manufactured by Chukyo Oils. Examples of commercially available products of the castor oil include purified castor oils manufactured by ITOH OIL CHEMICALS CO., LTD.

Among them, a carnauba wax having a melting point of 70° C. to 95° C. is particularly preferable in terms of capability of proving electrophotographic materials which are excellent in antioffset properties, adhesion resistance, paper conveyability, and glossiness and can form high-quality images with hardly causing cracks.

The animal wax is not particularly limited and may be suitably selected from among those known in the art, and examples thereof include beewax, lanolin, whale wax, whale oil, and sheep wool wax.

The mineral wax is not particularly limited and may be suitably selected from among those known in the art, and it may be a commercially available product or may be a suitably synthesized one. Examples thereof include montan wax, montan-based ester wax, ozokerite, and ceresin.

Of these, a montan wax having a melting point of 70° C. to 95° C. is particularly preferable in terms of capability of proving electrophotographic materials which are excellent in antioffset properties, adhesion resistance, paper conveyability, and glossiness and can form high-quality images with hardly causing cracks.

The petroleum wax is not particularly limited and may be suitably selected from among those known in the art, and it may be a commercially available product, or may be a suitably synthesized one. Examples of the petroleum wax include paraffin waxes, microcrystalline waxes, and petrolatum.

The content of the natural wax in the toner image-receiving layer is preferably 0.1 g/m$^2$ to 4 g/m$^2$, and more preferably 0.2 g/m$^2$ to 2 g/m$^2$.

When the content of the natural wax is less than 0.1 g/m$^2$, antioffset property and adhesion resistance of the image-receiving sheet may be particularly insufficient. When the content of the natural wax is more than 4 g/m$^2$, the quality of an image to be formed may be degraded due to the excessive amount of the wax.

The melting point (° C.) of the natural wax is preferably 70° C. to 95° C., and more preferably 75° C. to 90° C. particularly from the viewpoint of antioffset property and paper conveyability.

The synthesized waxes are divided into synthetic hydrocarbons, modified waxes, hydrogenated waxes, and other fat and fatty oil synthetic waxes. Among them, a water dispersible wax is preferable in terms of compatibility in the case where an aqueous thermoplastic resin is used as a thermoplastic resin for the toner image-receiving layer.

Examples of the synthetic hydrocarbons include Fischer-Tropsch waxes, and polyethylene waxes.

Examples of the fat and fatty oil synthetic waxes include acid amide compounds (such as stearic acid amid), and acid imide compounds (such as phthalic anhydride imide).

The modified wax is not particularly limited and may be suitably selected in accordance with the intended use, and examples thereof include amine-modified waxes, acrylic acid-modified waxes, fluorine-modified waxes, olefin-modified waxes, urethane-modified waxes, and alcohol waxes.

Examples of the hydrogenated wax is not particularly limited and may be suitably selected in accordance with the intended use, and examples thereof include hardened castor oils, castor oil derivatives, stearic acids, lauric aids, myristic acids, palmitic acids, behenyl acids, sebacic acids, undecylenic acids, heptyl acids, maleic acids, and highly maleated oils.

The melting point (° C.) of the releasing agent is preferably 70° C. to 95° C., and more preferably 75° C. to 90° C. particularly from the viewpoint of antioffset property and paper conveyability.

As a releasing agent to be added to materials of the toner image-receiving layer, a derivative, an oxide, a purified product, or a mixture of the above-noted releasing agents may also be used. Each of these compounds may have a reactive substituent group.

The content of the releasing agent is preferably 0.1% by mass to 10% by mass, more preferably 0.3% by mass to 8.0% by mass, and still more preferably 0.5% by mass to 5.0% by mass based on the mass of the toner image-receiving layer.

When the content of the releasing agent is less than 0.1% by mass, the antioffset property and adhesion resistance of the image-receiving sheet may be insufficient. When the content of the releasing agent is more than 10% by mass, the quality of an image to be formed may be degraded due to the excessive amount of the releasing agent.

—Plasticizer—

The plasticizer is not particularly limited and may be suitably selected from among plasticizers for resin in the art in accordance with the intended use.

The plasticizer has a function to control fluidization and tenderization of the toner image-receiving layer.

Examples of a reference for selecting the plasticizer include literatures, such as "Kagaku Binran (Chemical Handbook)" (edited by The Chemical Society of Japan and published by Maruzen Co., Ltd.), "Plasticizer, Theory and Application" (edited by Koichi Murai and published by Saiwai Shobo), "Volumes 1 and 2 of Studies on Plasticizer" (edited by Polymer Chemistry Association) and "Handbook on Compounding Ingredients for Rubbers and Plastics" (edited by Rubber Digest Co.).

Some plasticizers are described as an organic solvent having a high boiling point or a thermal solvent in some literatures. Examples of the plasticizer include esters (such as phthalate esters, phosphorate esters, fatty esters, abietate esters, adipate esters, sebacate esters, azelate esters, benzoate esters, butyrate esters, epoxidized fatty esters, glycolate esters, propionate esters, trimellitate esters, citrate esters, sulfonate esters, carboxylate esters, succinate esters, malate esters, fumarate esters, phthalate esters and stearate esters); amides (, such as fatty amides and sulfonate amides); ethers; alcohols; lactones and polyethylene oxides, which are described in patent documents, such as JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, and 02-235694.

These plasticizers may be incorporated in the composition of the resin.

Further, a plasticizer having a relatively low molecular mass can be also used. The plasticizer has a molecular mass which is preferably lower than that of a binder resin which is plasticized by the plasticizer and preferably 15,000 or less, more preferably 5,000 or less. In addition, when a plasticizer is a polymer, the plasticizer is preferably the same polymer as that of the binder resin which is plasticized by the plasticizer. For example, for plasticizing a polyester resin, the plasticizer is preferably a polyester having a low molecular mass. Further, an oligomer can be also used as a plasticizer.

Besides the above-noted compounds, examples of the plasticizer which is commercially available include ADEKA-CIZER PN-170 and PN-1430 (manufactured and sold by Asahi Denka Kogyo Co., Ltd.); PARAPLEX G-25, G-30 and G-40 (manufactured and sold by C. P. Hall Co., Ltd.); and ESTER GUM 8L-JA, ESTER R-95, PENTALIN 4851, FK 115, 4820, 830, LUISOL 28-JA, PICOLASTIC A75, PICOTEX LC and CRYSTALEX 3085 (manufactured and sold by Rika Hercules Co., Ltd.).

The plasticizer may be optionally used for relaxing the stress and strain (i.e., a physical strain, such as a strain in elastic force and viscosity and a strain due to a material balance in the molecule and the main chain and pendant moiety of the binder) which are caused when the toner particles are embedded in the toner image-receiving layer.

In the toner image-receiving layer, the plasticizer may be finely (microscopically) dispersed, may be in the state of a fine phase-separation in a sea-island structure and may be combined with other components, such as a binder resin.

The content of the plasticizer in the toner image-receiving layer is preferably 0.001% by mass to 90% by mass, more preferably 0.1% by mass to 60% by mass, still more preferably 1% by mass to 40% by mass, based on the mass of the toner image-receiving layer.

The plasticizer may be used for controlling slip properties (for improving the conveyability by reducing the friction), improving the offset of the toner at the fixing part of the fixing apparatus (peeling of the toner or the toner image-receiving layer to the fixing part) and controlling the curling balance and electrostatic charge (formation of a toner electrostatic image).

—Colorant—

The colorant is not particularly limited and may be suitably selected in accordance with the intended use. Examples of the colorant include a fluorescent whitening agent, a white pigment, a colored pigment and a dye.

The fluorescent whitening agent is note particularly limited as long as the agent is a conventional compound having the absorption in the near-ultraviolet region and emitting a fluorescence having a wavelength of 400 nm to 500 nm and may be suitably selected from among conventional fluorescent whitening agents. Preferred examples of the fluorescent whitening agent include the compounds described in the literature "The Chemistry of Synthetic Dyes, Volume V" (edited by K. Veen Rataraman, Chapter 8). The fluorescent whitening agent may be a commercially available product or a suitably synthesized product. Examples of the fluorescent whitening agent include stilbene compounds, coumarin compounds, biphenyl compounds, benzo-oxazoline compounds, naphthalimide compounds, pyrazoline compounds and carbostyril compounds. Examples of the commercially available fluorescent whitening agent include white FURFAR-PSN, PHR, HCS, PCS and B (manufactured and sold by Sumitomo Chemicals Co., Ltd.) and UVITEX-OB (manufactured and sold by Ciba-Geigy Corp.).

The white pigment is not particularly limited and may be suitably selected from among conventional white pigments depending on the application. Examples of the white pigment include an inorganic pigment, such as titanium oxide and calcium carbonate.

The colored pigment is not particularly limited and may be suitably selected from among conventional colored pigments. Examples of the colored pigment include various pigments described in JP-A No. 6344653, such as an azo pigment, a polycyclic pigment, a condensed polycyclic pigment, a lake pigment and a carbon black.

Examples of the azo pigment include an azo lake pigment (such as carmine 6B and red 2B), an insoluble azo pigment (such as monoazo yellow, disazo yellow, pyrazolone orange and Vulcan orange) and a condensed azo pigment (such as chromophthal yellow and chromophthal red).

Examples of the polycyclic pigment include a phthalocyanine pigment, such as copper phthalocyanine blue and copper phthalocyanine green.

Examples of the condensed polycyclic pigment include a dioxazine pigment (such as dioxazine violet), an isoindolinone pigment (, such as isoindolinone yellow), a threne pigment, a perylene pigment, a perinone pigment and a thioindigo pigment.

Examples of the lake pigment include malachite green, rhodamine B, rhodamine G and Victoria blue B.

Examples of the inorganic pigment include an oxide (, such as titanium dioxide and iron oxide red), a sulfate salt (such as precipitated barium sulfate), a carbonate salt (such as precipitated calcium carbonate) a silicate salt (such as a hydrous silicate salt and an anhydrous silicate salt) and a metal powder (such as aluminum powder, bronze powder, zinc powder, chrome yellow and iron blue).

Each of these pigments may be used alone or in combination with two or more.

The dye is not particularly limited and may be suitably selected from among conventional dyes depending on the application. Examples of the dye include anthraquinone compounds and azo compounds. These dyes may be used individually or in combination.

Examples of the water-insoluble dye include a vat dye, a disperse dye and an oil-soluble dye. Specific examples of the vat dye include C. I. Vat violet 1, C. I. Vat violet 2, C. I. Vat violet 9, C. I. Vat violet 13, C. I. Vat violet 21, C. I. Vat blue 1, C. I. Vat blue 3, C. I. Vat blue 4, C. I. Vat blue 6, C. I. Vat blue 14, C. I. Vat blue 20 and C. I. Vat blue 35. Specific examples of the disperse dye include C. I. disperse violet 1, C. I. disperse violet 4, C. I. disperse violet 10, C. I. disperse blue 3, C. I. disperse blue 7 and C. I. disperse blue 58. Specific examples of the oil-soluble dye include C. I. solvent violet 13, C. I. solvent violet 14, C. I. solvent violet 21, C. I. solvent violet 27, C. I. solvent blue 11, C. I. solvent blue 12, C. I. solvent blue 25 and C. I. solvent blue 55.

Colored couplers used in the silver halide photography may also be used preferably as the dye.

The content of the colorant in the toner image-receiving layer is preferably 0.1 $g/m^2$ to 8 $g/m^2$, and more preferably 0.5 $g/m^2$ to 5 $g/m^2$.

When the content of the colorant is less than 0.1 $g/m^2$, the light transmittance of the toner image-receiving layer may be high. In contrast, when the amount is more than 8 $g/m^2$, handling properties, such as crazing and adhesion resistance may be impaired.

Among the colorants, the added amount of a pigment is preferably 40% by mass or less, more preferably 30% by mass or less, and still more preferably 20% by mass or less based on the mass of the thermoplastic resin constituting the toner image-receiving layer.

Examples of the filler include an organic filler and an inorganic filler which is a reinforcing agent for the binder resin or a conventional filler as a reinforcer or a bulking agent. The filler may be properly selected by referring to "Handbook of Rubber and Plastics Additives" (edited by Rubber Digest Co.), "Plastics Blending Agents—Basics and Applications" (New Edition) (published by Taisei Co.) and "The Filler Handbook" (published by Taisei Co.).

Examples of the filler include an inorganic filler and an inorganic pigment. Specific examples of the inorganic filler or the inorganic pigment include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate and mullite. Among them, silica and alumina are most preferred. Each of these fillers may be used alone or in combination with two or more. It is preferred that the filler has a small particle diameter. When the filler has a large particle diameter, the surface of the toner image-receiving layer is easily roughened.

Examples of the silica include a spherical silica and an amorphous silica. The silica can be synthesized by a dry method, a wet method or an aerogel method. The silica may be also produced by treating the surface of the hydrophobic silica particles with a trimethylsilyl group or silicone. Preferred examples of the silica include a colloidal silica. The silica is preferably porous.

Examples of the alumina include an anhydrous alumina and a hydrated alumina. Examples of the crystallized anhydrous alumina include α-, β-, γ-, δ-, ξ-, η-, θ-, κ-, ρ- and χ-anhydrous alumina. The hydrated alumina is more preferred than the anhydrous alumina. Examples of the hydrated alumina include a monohydrated alumina and a trihydrate alumina. Examples of the monohydrated alumina include pseudo-boehmite, boehmite and disport. Examples of the trihydrated alumina include gibbsite and bayerite. The alumina is preferably porous.

The hydrated alumina can be synthesized by the sol-gel method in which ammonia is added to a solution of an aluminum salt to precipitate alumina or by a method of hydrolyzing an alkali aluminate. The anhydrous alumina can be obtained by heating to dehydrate a hydrated alumina.

The content of the filler is preferably 5 parts by mass to 2,000 parts by mass, relative to 100 parts by mass (in terms of dry mass) of the binder resin in the toner image-receiving layer.

The crosslinking agent may be incorporated in the resin composition of the toner image-receiving layer for controlling the shelf stability and thermoplasticity of the toner image-receiving layer. Examples of the crosslinking agent include a compound containing in the molecule two or more reactive groups selected from the group consisting of an epoxy group, an isocyanate group, an aldehyde group, an active halogen group, an active methylene group, an acetylene group and other conventional reactive groups.

Examples of the crosslinking agent include also a compound containing in the molecule two or more groups which can form a bond through a hydrogen bond, an ionic bond or a coordination bond.

Specific examples of the crosslinking agent include a compound which is conventional as a coupling agent, a curing agent, a polymerizing agent, a polymerization promoter, a coagulant, a film-forming agent or a film-forming assistant which is used for the resin. Examples of the coupling agent include chlorosilanes, vinylsilanes, epoxisilanes, aminosilanes, alkoxy aluminum chelates, titanate coupling agents and other conventional crosslinking agents described in the literature "Handbook of Rubber and Plastics Additives" (edited by Rubber Digest Co.).

The toner image-receiving layer preferably contains a charge control agent for controlling the transfer and adhesion of the toner and for preventing the adhesion of the toner image-receiving layer due to the charge.

The charge control agent is not particularly limited and may be suitably selected from among conventional various charge control agents depending on the application. Examples of the charge control agent include a surfactant, such as a cationic surfactant, an anionic surfactant, an amphoteric surfactant and a non-ionic surfactant; a polymer electrolyte and a conductive metal oxide. Specific examples of the charge control agent include a cationic antistatic agent, such as a quaternary ammonium salt, a polyamine derivative, a cation-modified polymethyl methacrylate, a cation-modified polystyrene; an anionic antistatic agent, such as an alkyl phosphate and an anionic polymer; and a non-ionic antistatic agent, such as a fatty ester and a polyethylene oxide.

When the toner is negatively charged, the charge control agent in the toner image-receiving layer is preferably a cationic or nonionic charge control agent.

Examples of the conductive metal oxide include ZnO, $TiO_2$, $SnO_2$, $A_2O_3$, $In_2O_3$, $SiO_2$, MgO, BaO and $MoO_3$. These conductive metal oxides may be used individually or in combination. The conductive metal oxide may contain (dope) another different element, for example, ZnO may contain (dope) Al and In; $TiO_2$ may contain (dope) Nb and Ta; and $SnO_2$ may contain (dope) Sb, Nb and a halogen element.

—Other Additives—

The toner image-receiving layer may also contain various additives for improving the stability of the output image or the stability of the toner image-receiving layer itself. Examples of the additives include various conventional antioxidants, anti-aging agents, deterioration inhibitors, ozone-deterioration inhibitors, ultraviolet ray absorbers, metal complexes, light stabilizers, antiseptic agents and anti-fungus agents.

The antioxidant is not particularly limited and may be suitably selected in accordance with the intended use. Examples of the antioxidant include a chroman compound, a coumarin compound, a phenol compound (e.g., a hindered phenol), a hydroquinone derivative, a hindered amine derivative and a spiroindane compound. With respect to the antioxidant, there is a description in JP-A No. 61-159644.

The anti-aging agent is not particularly limited and may be suitably selected in accordance with the intended use. Examples of the anti-aging agent include anti-aging agents described in the literature "Handbook of Rubber and Plastics Additives—Revised Second Edition" (published by Rubber Digest Co., 1993, pp. 76-121).

The ultraviolet ray absorber is not particularly limited and may be suitably selected in accordance with the intended use. Examples of the ultraviolet ray absorber include a benzotriazol compound (see U.S. Pat. No. 3,533,794), a 4-thiazolidone compound (see U.S. Pat. No. 3,352,681), a benzophenone compound (see JP-A No. 46-2784) and an ultraviolet ray absorbing polymer (see JP-A No. 62-260152).

The metal complex is not particularly limited and may be suitably selected in accordance with the intended use. Proper examples of the metal complex include metal complexes described in patent documents, such as U.S. Pat. Nos. 4,241,155, 4,245,018, and 4,254,195; and JP-A Nos. 61-88256, 62-174741, 63-199248, 01-75568 and 01-74272.

Also, preferred examples of the ultraviolet ray absorber or the light stabilizer include ultraviolet ray absorbers or light stabilizers described in the literature "Handbook on Compounding Ingredients for Rubbers and Plastics, revised second edition" (published by Rubber Digest Co., 1993, pp. 122-137).

The toner image-receiving layer may optionally contain the above-noted conventional additives for photography. Examples of the additive for photography include additives described in the literatures "Journal of Research Disclosure (hereinafter referred to as RD) No. 17643 (December, 1978), No. 18716 (November, 1979) and No. 307105 (November, 1989)". These additives are specifically noted with respect to the pages of the Journal RD which are to be referred to a table as shown in the following Table 1.

TABLE 1

| | Journal No. | | |
|---|---|---|---|
| Type of additives | RD17643 | RD18716 | RD307105 |
| Whitening agent | pp. 24 | p. 648 right column | pp. 868 |
| Stabilizer | pp. 24-25 | p. 649 right column | pp. 868-870 |
| Light absorber (Ultraviolet ray absorber) | pp. 25-26 | p. 649 right column | pp. 873 |
| Dye image stabilizer | pp. 25 | p. 650 right column | pp. 872 |
| Film hardener | pp. 26 | p. 651 left column | pp. 874-875 |
| Binder | pp. 26 | p. 651 left column | pp. 873-874 |
| Plasticizer, lubricant | pp. 27 | p. 650 right column | pp. 876 |
| Auxiliary coating agent (Surfactant) | pp. 26-27 | p. 650 right column | pp. 875-876 |
| Antistatic agent | pp. 27 | p. 650 right column | pp. 876-877 |
| Matting agent | — | — | pp. 878-879 |

The toner image-receiving layer is disposed on the support by coating the support with the coating solution containing a thermoplastic resin used for producing the toner image-receiving layer using a wire coater and by drying the resultant coating. The Minimum Film Forming Temperature (MFT) of the thermoplastic resin used in the present invention is preferably room temperature or higher during the storage of the image-receiving sheet before the printing and preferably 100° C. or lower during the fixing of the toner particles.

The mass of the dried coating as the toner image-receiving layer is preferably from 1 g/m$^2$ to 20 g/m$^2$, more preferably from 4 g/m$^2$ to 15 g/m$^2$.

The thickness of the toner image-receiving layer is not particularly limited and may be suitably selected in accordance with the intended use. The thickness is preferably ½ or more of the diameter of the toner particles, more preferably from 1 time to 3 times the diameter of the toner particles. More specifically, the thickness is preferably from 1 μm to 50 μm, more preferably from 1 μm to 30 μm, still more preferably from 2 μm to 20 μm, most preferably from 5 μm to 15 μm.

[Physical Properties of Toner Image-Receiving Layer]

The 180-degree peel strength of the toner image-receiving layer at the temperature for the image-fixing at which the image is fixed on the fixing member is preferably 0.1 N/25 mm or less, more preferably 0.041 N/25 mm or less. The 180-degree peel strength can be measured according to the method described in JIS K 6887 using a surface material of the fixing member.

It is preferred that the toner image-receiving layer has the whiteness of a high degree. The whiteness is measured by the method described in JIS P 8123 and is preferably 85% or more. It is preferred that the spectral reflectance of the toner image-receiving layer is 85% or more in the wavelength range of from 440 nm to 640 nm and the difference between the maximum spectral reflectance of the toner image-receiving layer and the minimum spectral reflectance of the toner image-receiving layer in the above-noted wavelength range is within 5%. Further, it is more preferred that the spectral reflectance of the toner image-receiving layer is 85% or more in the wavelength range of from 400 nm to 700 nm and the difference between the maximum spectral reflectance of the toner image-receiving layer and the minimum spectral reflectance of the toner image-receiving layer in the above-noted wavelength range is within 5%.

With respect to the whiteness of the toner image-receiving layer, specifically, in the CIE 1976 (L* a* b*) color space, an L* value is preferably 80 or more, more preferably 85 or more, still more preferably 90 or more. The tone of the whiteness is preferably as neutral as possible and more specifically, with respect to the tone of the whiteness of the toner image-receiving layer, in the (L* a* b*) space, the value of $(a^*)^2+(b^*)^2$ is preferably 50 or less, more preferably 18 or less, still more preferably 5 or less.

It is preferred that the toner image-receiving layer has high glossiness after the image forming. With respect to the gloss level of the toner image-receiving layer, through the range of from the state in which the toner image-receiving layer is white (i.e., there is no toner in the toner image-receiving layer) to the state in which the toner image-receiving layer is black (i.e., there is full of the toner in the toner image-receiving layer), the 45-degree gloss level of the toner image-receiving layer is preferably 60 or more, more preferably 75 or more, still more preferably 90 or more.

However, the gloss level of the toner image-receiving layer is preferably 110 or less. When the gloss level is more than 110, the image has a metallic luster and such a quality of the image is undesirable.

The gloss level can be measured according to JIS Z 8741.

It is preferred that the toner image-receiving layer has high smoothness after the fixing. With respect to the smoothness of the toner image-receiving layer, through the range of from the state in which the toner image-receiving layer is white (i.e., there is no toner in the toner image-receiving layer) to the state in which the toner image-receiving layer is black (i.e., there is full of the toner in the toner image-receiving layer), the arithmetic average roughness (Ra) of the toner image-receiving layer is preferably 3 μm or less, more preferably 1 μm or less, still more preferably 0.5 μm or less.

The arithmetic average roughness can be measured, for example, according to the methods described in JIS B 0601, B 0651 and B 0652.

The toner image-receiving layer has preferably one of the physical properties described in the following items (1) to (6), more preferably several of them, most preferably all of them.

(1) The melt temperature ($T_m$) of the toner image-receiving layer is preferably 30° C. or higher, more preferably a temperature which is higher than $T_m$ of the toner by 20° C., or lower.

(2) The temperature at which the viscosity of the toner image-receiving layer is $1\times10^5$ cp is preferably 40° C. or higher, more preferably a temperature which is lower than the temperature at which the viscosity of the toner is $1\times10^5$ cp.

(3) The storage elasticity modulus (G') of the toner image-receiving layer at the temperature for the image-fixing is preferably from $1\times10^2$ Pa to $1\times10^5$ Pa and the loss elasticity modulus (G") of the toner image-receiving layer at the temperature for the image-fixing is preferably from $1\times10^2$ Pa to $1\times10^5$ Pa.

(4) The loss tangent (G"/G') of the toner image-receiving layer at the fixing temperature is preferably from 0.01 to 10, wherein the loss tangent is the ratio of the loss elasticity modulus (G") to the storage elasticity modulus (G').

(5) The storage elasticity modulus (G') of the toner image-receiving layer at the fixing temperature differs from the storage elasticity modulus (G') of the toner at the fixing temperature, preferably by −50 to +2,500.

(6) The inclination angle of the molten toner on the toner image-receiving layer is preferably 50° or less, more preferably 40° or less.

The toner image-receiving layer preferably satisfies the physical properties described in Japanese Patent No. 2788358 and JP-A Nos. 07-248637, 08-305067 and 10-239889.

The surface electrical resistance of the toner image-receiving layer is preferably in the range of from $1\times10^6$ Ω/cm$^2$ to $1\times10^{15}$ Ω/cm$^2$ (under conditions of 25° C. and 65% RH).

When the surface electrical resistance is less than $1\times10^6$ Ω/cm$^2$, the amount of the toner transferred to the toner image-receiving layer is unsatisfactory, and thus a disadvantage is caused wherein the density of the obtained toner image becomes easily too low. In contrast, when the surface electrical resistance is more than $1\times10^{15}$ Ω/cm$^2$, more charge than the necessity is generated in the toner image-receiving layer during the transfer, and thus disadvantages are caused wherein the toner is transferred so unsatisfactorily that the density of the obtained image is low and the electrophotographic image-receiving label sheet is electrostatically charged, so that the image-receiving sheet adsorbs easily the dust. Moreover, in this case, miss field, multi feed, discharge marks and toner transfer dropout may occur during the copying.

The surface electrical resistance of the toner image-receiving layer can be measured according to the method described in JIS K 6911 as follows. The sample of the toner image-receiving layer is left under the condition where the temperature is 20° C. and the humidity is 65% for 8 hours or more and after applying a voltage of 100 V to the sample of the toner image-receiving layer for 1 minute under the same condition as the above-noted condition, the surface electrical resistance of the toner image-receiving layer can be measured using a micro-ammeter R8340 (manufactured and sold by Advantest Ltd.).

[Other Layers]

Examples of the other layers which the image-receiving sheet for electrophotography contains include, a surface-protecting layer, a back layer, an adhesion-improving layer, an intermediate layer, an undercoating layer, a cushion layer, a charge-controlling (preventing) layer, a reflective layer, a tint-controlling layer, a shelf stability-improving layer, an anti-adhesion layer, an anti-curling layer and a smoothing layer. These layers may be in a single layer structure or a laminated structure of plural layers.

—Surface Protective Layer—

The surface protective layer may be disposed on the surface of the toner image-receiving layer for protecting the surface of the image-receiving sheet for electrophotography according to the present invention, improving shelf stability, handling properties and conveyability thereof, and imparting writing properties and anti-offset properties thereto. The surface protective layer may have a single-layer structure or a laminated structure of two or more layers. The surface protective layer may contain as a binder resin at least one of various thermoplastic resins and thermosetting resins which is preferably a resin of the same type as that of a resin used for the toner image-receiving layer. In this case, however, a resin used for the surface protective layer needs not to have the same thermodynamic properties or electrostatic properties as those of a resin used for the toner image-receiving layer and those properties of the surface protective layer can be respectively optimized.

The surface protective layer may contain the above-noted various additives which can be used for producing the toner image-receiving layer. Particularly, the surface protective layer may contain together with the above-noted releasing agent used in the present invention, other additives such as a matting agent. Examples of the matting agent include various conventional matting agents.

The outermost surface layer of the image-receiving sheet for electrophotography (e.g., the surface protective layer when it is disposed) has preferably good compatibility with the toner from the viewpoint of good fixability of the toner image. More specifically, the outermost surface layer has preferably a contact angle with the molten toner of from 0° to 40°.

—Back Layer—

The back layer in the image-receiving sheet for electrophotography according to the present invention is preferably disposed on a surface of the support, which is opposite to another surface of the support on which the toner image-receiving layer is disposed, for imparting back side-output suitability to the image-receiving sheet and improving the image quality of the back side-output, curling balance and conveyability of the image-receiving sheet.

The color of the back layer is not particularly limited and may be suitably selected in accordance with the intended use, however, when the image-receiving sheet for electrophotography according to the present invention is an image-receiving sheet of the both-side output type forming an image also on the back side thereof, however, also the color of the back layer is preferably white. The back layer has preferably whiteness of 85% or more and spectral reflectance of 85% or more, like the image-receiving layer.

Moreover, for improving both-side output suitability, the back layer may have a composition same as that of the front side of the sheet, which contains the toner image-receiving layer. The back layer may contain besides the above-noted particles, the above-explained various additives. It is appropriate that as the additives, particularly a charge control agent is used. The back layer may have a single-layer structure or a laminated structure of two or more layers.

When for preventing the offset during the image-fixing, an oil having release properties is applied to the fixing roller, the back layer may have oil absorbency.

Usually, the thickness of the back layer is preferably 0.1 μm to 10 μm.

—Adhesion-Improving Layer—

The adhesion-improving layer in the image-receiving sheet for electrophotography according to the present invention is preferably disposed for improving adhesion between the support and the toner image-receiving layer. The adhesion-improving layer may contain the above-noted various additives, particularly preferably the crosslinker. Further, it is preferred that in the image-receiving sheet for electrophotography according to the present invention, for improving the toner receptivity, a cushion layer is disposed between the adhesion improving layer and the image-receiving layer.

—Intermediate Layer—

The intermediate layer may be formed, for example, between the support and the adhesion-improving layer, between the adhesion-improving layer and the cushion layer, between the cushion layer and the toner image-receiving layer, or between the toner image-receiving layer and the shelf stability improving layer. When the image-receiving sheet for electrophotography contains the support, the toner image-receiving layer and the intermediate layer, the intermediate layer may be disposed, for example, between the support and the toner image-receiving layer.

The thickness of the image-receiving sheet for electrophotography according to the present invention is not particularly limited and may be suitably selected in accordance with the intended use. The thickness is preferably from 50 μm to 550 μm, and more preferably from 100 μm to 350 μm.

<Toner>

The image-receiving sheet for electrophotography according to the present invention is used by causing the toner image-receiving layer to receive the toner during the printing and copying.

The toner contains at least a binder resin and a colorant, and optionally a releasing agent and other components.

The toner contains at least a binder resin and a colorant, and further contains a releasing agent and other components in accordance with the necessity.

—Binder Resin for Toner—

The binder resin is not particularly limited and may be suitably selected from resins used usually for producing the toner in accordance with the intended use. Examples of the binder resin include homo-polymers or copolymers produced by polymerizing or copolymerizing a vinyl monomer or two or more vinyl monomers selected from the group consisting of vinyl monomers, such as styrenes, such as styrene and parachlorostyrene; vinyl esters, such as vinyl naphthalene, vinyl chloride, vinyl bromide, vinyl fluoride, vinyl acetate, vinyl propioniate, vinyl benzoate and vinyl butyrate; methylene fatty carboxylate esters, such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; vinyl nitriles, such as acrylonitrile, methacrylonitrile and acrylamide; vinyl ethers, such as vinyl methyl ether, vinyl ethyl ether and vinyl isobutyl ether; N-vinyl compounds, such as N-vinyl pyrrole, N-vinyl carbazole, N-vinyl indole and N-vinyl pyrrolidone; and vinyl carboxylic acids, such as methacrylic acid, acrylic acid and cinnamic acid. Examples of the binder resin include also various polyesters. The above-noted examples of the binder resin may be used in combination with various waxes.

Among these resins, a resin of the same type as that of the resin used for producing the toner image-receiving layer according to the present invention is preferably used.

—Colorant for Toner—

The colorant used for the toner is not particularly limited and may be suitably selected from colorants used usually for producing the toner in accordance with the intended use. Examples of the colorant include various pigments, such as carbon black, chrome yellow, hansa yellow, benzidine yellow, threne yellow, quinoline yellow, Permanent Orange GTR, Pyrazolone orange, vulcan orange, watchung red, permanent red, Brilliant Carmine 3B, Brilliant Carmine 6B, Du Pont Oil Red, Pyrazolone Red, Lithol Red, Rhodamine B lake, Lake Red C, Rose Bengal, aniline blue, ultra marine blue, chalco oil blue, methylene blue chloride, phthalocyanine blue, phthalocyanine green, malachite green oxalate; and various dyes such as acridine dyes, xanthene dyes, azo dyes, benzoquinone dyes, azine dyes, anthraquinone dyes, indigo dyes, thioindigo dyes, dioxazine dyes, thiazine dyes, azomethine dyes, phthalocyanine dyes, aniline black dyes, polymethine dyes, triphenylmethane dyes, diphenylmethane dyes and thiazole dyes.

Each of these colorants may be used alone or in combination with two or more.

The content of the colorant is not particularly limited and may be suitably selected in accordance with the intended use. The content is preferably from 2% to 8% by mass, based on the mass of the toner. When the content of the colorant is less than 2% by mass, the coloring power of the toner may be weakened. In contrast, when the content is more than 8% by mass, the clarity of the toner may be impaired.

—Releasing Agent for Toner—

The releasing agent used for the toner is not particularly limited and may be suitably selected from releasing agents used usually for the toner in accordance with the intended use. Particularly effective examples of the releasing agent include a highly crystalline polyethylene wax having a relatively low molecular mass, a Fischer-Tropsch wax, amide wax and a polar wax containing nitrogen, such as a compound having a urethane bond.

The polyethylene wax has a molecular mass of preferably 1,000 or less, and more preferable from 300 to 1,000.

The compound having a urethane bond is preferred in that even if the compound has a low molecular mass, the compound can maintain a solid state by a strong cohesive force of a polar group and such a compound having a high melting point for the molecular mass thereof can be produced. The compound has a molecular mass of preferably from 300 to 1,000. Examples of a combination of materials for producing the compound having a urethane bond include a combination of a diisocyanic acid compound and a monohydric alcohol, a combination of a monoisocyanic acid compound and a monohydric alcohol, a combination of a dihydric alcohol and a monoisocyanic acid compound, a combination of a trihydric alcohol and a monoisocyanic acid compound and a combination of a triisocyanic acid compound and a monohydric alcohol. However, for preventing the molecular mass of the compound from becoming too large, a combination of a compound having a multiple functional group and another compound having a single functional group is preferred and it is important that the total amount of the functionality in a combination is always equivalent.

Examples of the monoisocyanic acid compound include dodecyl isocyanate, phenyl isocyanate (and derivatives thereof), naphthyl isocyanate, hexyl isocyanate, benzyl isocyanate, butyl isocyanate and allyl isocyanate.

Examples of the diisocyanic acid compound include tolylene diisocyanate, 4,4' diphenylmethane diisocyanate, toluene diisocyanate, 1,3-phenylene diisocyanate, hexamethylene diisocyanate, 4-methyl-m-phenylene diisocyanate and isophorone diisocyanate.

Examples of the monohydric alcohol include methanol, ethanol, propanol, butanol, pentanol, hexanol and heptanol.

Examples of the dihydric alcohol include various glycols, such as ethylene glycol, diethylene glycol, triethylene glycol and trimethylene glycol.

Examples of the trihydric alcohol include trimethylol propane, triethylol propane and trimethanol ethane.

Each of these urethane compounds may be mixed with a resin or a colorant during the kneading like a usual releasing agent to be used as a kneaded-ground type toner. When these urethane compounds are used for producing the toner produced according to the emulsion polymerization-cohesion and melting method, an aqueous dispersion of the releasing agent particles having a size of 1 μm or less is prepared according to a method including dispersing in water the urethane compound together with an ionic surfactant and a polymeric electrolyte, such as a polymeric acid and a polymeric base, thereby obtaining a dispersion of a releasing agent, heating the obtained dispersion to the melting point of the urethane compound or higher, and grinding the urethane compound until the urethane compound becomes in the form of fine particles by subjecting the above-noted dispersion to a strong shearing force using a homogenizer or a dispersing apparatus of a pressure discharge type, and the prepared dispersion of fine particles of the releasing agent is used in combination with a dispersion of resin particles and a dispersion of colorant particles to produce the toner produced according to the emulsion polymerization-cohesive melting method.

—Other Components for Toner—

The toner may contain other components such as an inner additive, a charge control agent and inorganic fine particles. Examples of the inner additive include a magnetic material, for example, a metal such as ferrite, magnetite, reduced iron, cobalt, nickel and manganese; an alloy thereof; and a compound containing these metals.

Examples of the charge control agent include various charge control agents used usually such as a quaternary ammonium salt, a nigrosine compound, a dye containing a complex of a metal (such as aluminum, iron and chromium) and a triphenylmethane pigment. It is preferred that the charge control agent is difficultly dissolved in water, from the view point of suppressing the ion strength in the toner, which may affect the stability of the charge control agent during the cohesion and the melting and reducing the pollution by the waste water.

Examples of the inorganic fine particles include all usual external additives of the toner surface, such as silica, alumina, titania, calcium carbonate, magnesium carbonate and tricalcium phosphate. These particles are preferably used in the form of a dispersion produced by dispersing the particles in an ionic surfactant, a polymer acid or a polymer base.

Further, the toner may contain as an additive a surfactant for the emulsion polymerization, the seed emulsion polymerization, the pigment dispersion, the resin particles dispersion, the releasing agent dispersion, the cohesion and stabilization thereof. Examples of the surfactant include an anionic surfactant, such as a sulfate ester surfactant, a sulfonate ester surfactant, a phosphate ester surfactant and a soap; a cationic surfactant such as an amine salt surfactant and a quaternary ammonium salt surfactant. It is also effective that the above-exemplified surfactants are used in combination with a nonionic surfactant such as a polyethylene glycol surfactant, an alkylphenol ethylene oxide adduct surfactant and a polyhydric alcohol surfactant. As a dispersing unit for dispersing the surfactant in the toner, a general unit such as a rotary shearing type homogenizer; and a ball mill, a sand mill and DYNO mill, all of which contain the media can be used.

The toner may contain optionally an external additive. Examples of the external additive include inorganic particles and organic particles. Examples of the inorganic particles include particles of $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $A_2O_3.2SiO_2$, $CaCO_3$, $MgCO_3$, $BaSO_4$ and $MgSO_4$. Examples of the organic particles include particles of a fatty acid and derivatives thereof; a metal salt of the above-noted fatty acid and derivatives thereof; and a resin such as a fluorine resin, a polyethylene resin, and an acrylic resin.

The average particle diameter of the above-noted particles is preferably from 0.01 μm to 5 μm, more preferably from 0.1 μm to 2 μm.

The method for producing the toner is not particularly limited and may be suitably selected in accordance with the intended use. However, it is preferred that the toner is produced according to a production method of the toner including (i) preparing a dispersion of cohesive particles of a resin by forming cohesive particles in a dispersion of resin particles, (ii) forming attached particles by mixing the above-prepared dispersion of cohesive particles with a dispersion of fine particles so that the fine particles attaches to the cohesive particles, thereby forming attached particles and (iii) forming toner particles by heating the attached particles to melt the attached particles.

—Physical Properties of Toner—

The toner according to the present invention has a volume average particle diameter of preferably from 0.5 μm to 10 μm. When the volume average particle diameter of the toner is too small, handling properties of the toner (such as replenish properties, cleaning properties and fluidity) may be affected adversely and the productivity of the particles may be lowered. In contrast, when the volume average particle diameter of the toner is too large, the quality and resolution of the image due to graininess and transferability may be affected adversely.

It is preferred that the toner according to the present invention satisfies the above-noted range of a volume average particle diameter and has a distribution index of the volume average particle diameter (GSDv) of 1.3 or less.

The ratio (GSDv/GSDn) of the distribution index of the volume average particle diameter (GSDv) to the distribution index of the number average particle diameter (GSDn) is preferably 0.95 or more.

It is preferred that the toner according to the present invention satisfies the above-noted range of the volume average particle diameter and has an average (1.00 to 1.50) of the shape factor calculated according to the following equation:

$$\text{Shape factor}=(\pi\times L^2)/(4\times S)$$

wherein L represents the maximum length of the toner particles and S represents the projected area of the toner particles.

When the toner satisfies the above-noted conditions, an effect on the image quality, such as graininess and resolution particularly can be obtained and moreover, dropout or blur which may accompany with the transfer is difficulty caused. Further, in this case, the handling properties of the toner may be difficulty affected adversely, even if the average particle diameter of the toner is not small.

From the viewpoint of improving the image quality and preventing the offset during the image-fixing, it is appropriate that the toner has storage elasticity modulus G' (as measured at an angular frequency of 10 rad/sec) of $1\times10^2$ Pa to $1\times10^5$ Pa at 150° C.

The image-receiving sheet for electrophotography of the present invention is excellent in curling properties and conveyability without substantially causing nonuniformity of images, and blisters, and thus the image-receiving sheet for electrophotography is preferably used for recording high-quality images.

(Image Forming Process)

The process of forming an image on an image-receiving sheet for electrophotography of the present invention includes forming the toner image and fixing the image and smoothing the image surface, and includes fixing the toner image by heating and other steps in accordance with the necessity.

—Formation of Toner Image—

The forming of the toner image is not particularly limited so long as by the forming, the toner image can be formed in the image-receiving sheet for electrophotography and may be suitably selected in accordance with the intended use. Examples of the forming of the toner image include a usual method used for the electrophotography such as a direct transfer method in which the toner image formed on the developing roller is directly transferred to the image-receiving sheet for electrophotography; or an intermediate transfer belt method in which the toner image formed on the developing roller is primary-transferred to the intermediate transfer belt and the primary-transferred image is transferred to the image-receiving sheet for electrophotography. Among them, from the viewpoint of environmental stability and enhancing the image quality, the intermediate transfer belt method is preferably used.

—Fixing the Toner Image by Heating the Toner Image—

The toner image may be subjected to a fixing treatment of the toner image by heating the toner image between the forming the toner image and the subsequent step of fixing the toner image and smoothing the image surface. The fixing the toner image by heating the toner image is a step in which the toner image which has been formed by forming the toner image is heated using any one of fixing rollers, a fixing belt, and a combination thereof to thereby fix the toner image.

The heating temperature is not particularly limited and may be suitably adjusted in accordance with the intended use, and typically, a toner image is preferably heated at 80° C. to 200° C.

—Fixing the Image and Smoothing the Image Surface—

The fixing the toner image and smoothing the surface of the toner image is a step in which the surface of the toner image which has been formed by the forming of the toner image is smoothened. The fixing the toner image and smoothing the surface of the toner image is performed by heating, pressurizing and cooling the toner image and by peeling the toner image-receiving sheet from the belt using an apparatus configured to fix the toner image and smooth the surface of the image, which is equipped with a heating-pressurizing unit, a belt and a cooling unit.

The apparatus configured to fix an image and smooth the image surface contains a heating-pressurizing unit, a belt, a cooling unit, a cooling-peeling part and further contains optionally other units.

The heating-pressurizing unit is not particularly limited and may be suitably selected in accordance with the intended use. Examples of the heating-pressurizing unit include a pair of heat rollers and a combination of a heat roller and a pressurizing roller.

The cooling unit is not particularly limited and may be suitably selected in accordance with the intended use. Examples of the cooling unit include a cooling unit which can blow a cool air and can control the cooling temperature, and a heat sink.

The cooling-peeling part is not particularly limited and may be suitably selected in accordance with the intended use. Examples of the cooling-peeling part include a section which is near of the tension roller where the image-receiving sheet for electrophotography is peeled from the belt by own stiffness (nerve) of the image-receiving sheet.

For contacting the toner image with a heating-pressurizing unit of the apparatus configured to fix the image and smooth the image surface, the image-receiving sheet is preferably pressurized. The method for pressurizing the image-receiving sheet is not particularly limited and may be suitably selected in accordance with the intended use; however, a nip pressure is preferably used. The nip pressure is, from the viewpoint of forming an image which is excellent in water resistance and surface smoothness and has excellent gloss, preferably from 1 kgf/cm$^2$ to 100 kgf/cm$^2$, more preferably from 5 kgf/cm$^2$ to 30 kgf/cm$^2$. The heating temperature in the heating-pressurizing unit is a temperature which is higher than the softening point of the polymer used for the toner image-receiving layer and is varied depending on the type of the polymer used for the toner image-receiving layer, however is usually preferably from 80° C. to 200° C. The cooling temperature in the cooling unit is preferably a temperature which is 80° C. or less at which the polymer layer as the toner image-receiving layer is satisfactorily set, and more preferably from 20° C. to 80° C.

The belt contains a heat-resistant support film and a releasing layer disposed on the support film.

The material for the support film is not particularly limited and may be suitably selected in accordance with the intended use as long as the material has heat resistance. Examples of the material include polyimide (PI), polyethylene naphthalate (PEN), polyethylene terephthalate (PET), polyether ether ketone (PEEK), polyether sulfone (PES), poly ether imide (PEI) and poly parabanic acid (PPA).

The releasing layer preferably contains at least one selected from the group consisting of a silicone rubber, a fluorine rubber, a fluorocarbon siloxane rubber, a silicone resin, and a fluorine resin. Among them, the following aspects are preferred. Specifically, an aspect of a belt in which a fluorocarbon siloxane rubber-containing layer is disposed on the surface of the belt support; and an aspect of a belt in which a silicone rubber-containing layer is disposed on the surface of the belt and a fluorocarbon siloxane rubber-containing layer disposed on the surface of the silicone rubber-containing layer.

The fluorocarbon siloxane rubber in the fluorocarbon siloxane rubber-containing layer has preferably in the main chain thereof at least one of a perfluoroalkyl ether group and a perfluoroalkyl group.

The fluorocarbon siloxane rubber is preferably a cured form of a fluorocarbon siloxane rubber composition containing the following components (A)-(D):

(A) a fluorocarbon polymer containing mainly a fluorocarbon siloxane represented by the following General Formula (1)

and having an unsaturated fatty hydrocarbon group, (B) at least one of organopolysiloxane and fluorocarbon siloxane which have two or more ═SiH groups in the molecule, wherein the amount of a ═SiH group is from one to four times (in mole) the amount of the unsaturated fatty hydrocarbon group in the above-noted fluorocarbon siloxane rubber composition, (C) a filler, and (D) an effective amount of catalyst.

The fluorocarbon polymer as the component (A) contains mainly a fluorocarbon siloxane containing a recurring unit represented by the following formula (1) and contains an unsaturated fatty hydrocarbon group.

Formula (1)

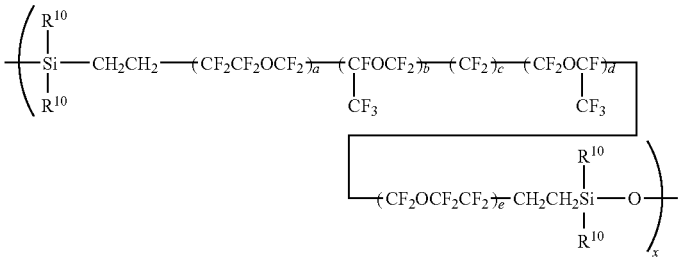

In formula (1), $R^{10}$ represents an unsubstituted or substituted monovalent hydrocarbon group having 1 to 8 carbon atoms and is preferably an alkyl group having 1 to 8 carbon atoms or a alkenyl group having 2 to 3 carbon atoms, most preferably a methyl group; "a" and "e" are respectively an integer of 0 or 1, "b" and "d" are respectively an integer of 1 to 4 and "c" is an integer of 0 to 8; and "x" is preferably an integer of 1 or more, more preferably an integer of 10 to 30.

Examples of the component (A) include a compound represented by the following formula (2):

Formula (2)

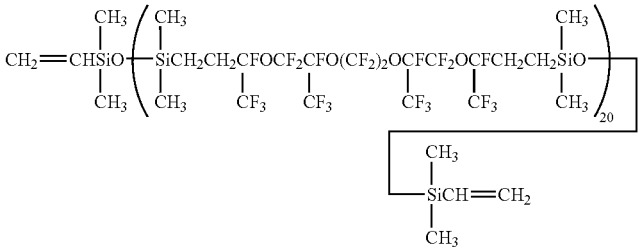

With respect to the component (B), examples of the organopolysiloxane having ═SiH groups include an organohydrogen polysiloxane having in the molecule at least two hydrogen atoms bonded to a silicon atom.

In the fluorocarbon siloxane rubber composition, when the fluorocarbon polymer as the component (A) has an unsaturated fatty hydrocarbon group, as a curing agent, the above-noted organohydrogen polysiloxane is preferably used. In other words, the cured form is produced by an addition reaction between the unsaturated fatty hydrocarbon group of the fluorocarbon siloxane and a hydrogen atom bonded to a silicon atom in the organohydrogen polysiloxane.

Examples of the organohydrogen polysiloxane include various organohydrogen polysiloxanes used for curing a silicone rubber composition which is cured by an addition reaction.

The amount of the organohydrogen polysiloxane is an amount by which the number of ═SiH groups in the organohydrogen polysiloxane is preferably at least one, most preferably from 1 to 5, relative to one unsaturated fatty hydrocarbon group in the fluorocarbon siloxane of the component (A).

Also, with respect to the component (B), preferred examples of the fluorocarbon siloxane having the ═SiH groups include a fluorocarbon siloxane having a structure of the recurring unit represented by the formula (1), and a fluorocarbon siloxane having a structure of the recurring unit represented by the formula (1) in which $R^{10}$ is a dialkylhydrogen siloxy group and the terminal group is a ═SiH group, such as a dialkylhydrogen siloxy group or a silyl group. Such a preferred fluorocarbon siloxane can be represented by the following formula (3).

Formula (3)

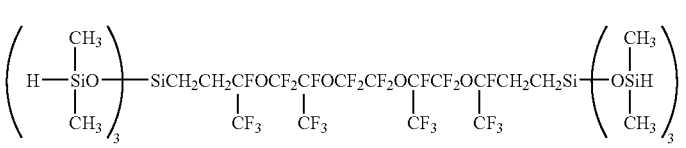

As the filler which is the component (C), various fillers used for a usual silicone rubber composition can be used. Examples of the filler include a reinforcing filler such as a mist silica, a precipitated silica, a carbon powder, titanium dioxide, aluminum oxide, a quartz powder, talc, sericite and bentonite; and a fiber filler, such as an asbesto, a glass fiber, and an organic fiber.

Examples of the catalyst as the component (D) include an element belonging to Group VIII in the Periodic Table and a compound thereof such as chloroplatinic acid; alcohol-modified chloroplatinic acid; a complex of chloroplatinic acid with an olefin; platinum black and palladium which are respectively supported on a carrier such as alumina, silica and carbon; a complex of rhodium with an olefin, chlorotris(triphenylphosphine) rhodium (Wilkinson catalyst) and rhodium (III) acetyl acetonate, which are conventional catalysts for addition reaction. It is preferred that these complexes are dissolved in a solvent, such as an alcohol compound, an ether compound or a hydrocarbon compound to be used.

The fluorocarbon siloxane rubber composition is not particularly limited and may be suitably selected in accordance with the intended use and optionally may contain various additives. Examples of the various additives include dispersing agents such as a diphenylsilane diol, a low polymer of dimethyl polysiloxane in which the terminal of the molecule chain is blocked with a hydroxyl group, and a hexamethyl disilazane; a heat resistance improver such as ferrous oxide, ferric oxide, cerium oxide and iron octylate; and colorants such as a pigment.

The belt can be obtained by coating the surface of a heat-resistant support film with the fluorocarbon siloxane rubber composition and by curing and heating the surface of the resultant coated support film. Further optionally, the belt can be obtained by coating the surface of the support film with a coating solution prepared by diluting the fluorocarbon siloxane rubber composition with a solvent such as m-xylene hexafluoride and benzotrifluoride according to a general coating method such as spray coating, dip coating and knife coating. The heating-curing temperature and time may be properly selected from the ranges of from 100° C. to 500° C. (temperature) and from 5 seconds to 5 hours (time) depending on the type of the support film and the production method of the belt.

The thickness of the releasing layer disposed on the surface of the heat-resistant support film is not particularly limited and may be suitably adjusted in accordance with the intended use. For obtaining advantageous fixing properties of an image by suppressing the release properties of the toner or by preventing the offset of the toner components, the thickness is preferably from 1 μm to 200 μm, more preferably from 5 μm to 150 μm.

Here, with respect to an example of the apparatus configured to fix an image and smooth the image surface, which was used in the image forming apparatus in the present invention, explanations are given in detail with referring to FIG. 1.

First, by an image forming apparatus (not illustrated in FIG. 1), a toner 12 is transferred to an image-receiving sheet for electrophotography 1 (hereinafter, may be referred to as "electrophotographic recording material"). The electrophotographic recording material 1 to which the toner 12 adhered is conveyed to the point A by a conveying unit (not illustrated in FIG. 1) and passes through between a heat roller 14 and a pressurizing roller 15 to be heated and pressed at the temperature (fixing temperature) and under the pressure, wherein the temperature and pressure are enough high to satisfactorily soften the toner image-receiving layer of the electrophotographic recording material 1 or the toner 12.

Here, the fixing temperature means a temperature of the surface of the toner image-receiving layer measured in a nip space between the heat roller 14 and the pressurizing roller 15 at the point A, and for example, the fixing temperature is preferably from 80° C. to 190° C., more preferably from 100° C. to 170° C. The (fixing) pressure means a pressure of the surface of the toner image-receiving layer measured also in a nip space between the heat roller 14 and the pressurizing roller 15 at the point A, and for example, the fixing pressure is preferably from 1 kgf/cm$^2$ to 10 kgf/cm$^2$ (9.8N/cm$^2$ to 98 N/cm$^2$), more preferably from 2 kgf/cm$^2$ to 7 kgf/cm$^2$ (19.6N/cm$^2$ to 68.6N/cm$^2$).

The thus heated and pressurized electrophotographic recording material 1 is, next, conveyed by a fixing belt 13 to a cooling unit 16 and during the conveyance of the electrophotographic recording material 1, in the electrophotographic recording material 1, a mold-releasing agent (not illustrated in FIG. 1) dispersed in the toner image-receiving layer is satisfactorily heated and molten. The molten mold-releasing agent is gathered to the surface of the toner image-receiving layer so that in the surface of the toner image-receiving layer, a layer (film) of the mold-releasing agent is formed. The electrophotographic recording material 1 is conveyed to the cooling unit 16 by the fixing belt 13 and then cooled by the cooling unit 16 to a temperature which is, for example, not higher than either the softening point of a binder resin used for producing the toner image-receiving layer or the toner, or to a temperature which is lower than the glass transition point of the above-noted binder resin plus 10° C., wherein the temperature to which the electrophotographic recording material 1 is cooled is preferably from 20° C. to 80° C., more preferably room temperature (25° C.). Thus, the layer (film) of the mold-releasing agent formed in the surface of the toner image-receiving layer is cooled and set, thereby forming the mold-release agent layer.

The cooled electrophotographic recording material 1 is conveyed by the fixing belt 13 further to the point B and the fixing belt 13 moves along the tension roller 17. Accordingly, at the point B, the electrophotographic recording material 1 is peeled from the fixing belt 13. It is preferred that the diameter of the tension roller 17 is so small designed that the electrophotographic recording material 1 can be peeled from the fixing belt 13 by own stiffness (nerve) of the electrophotographic recording material 1.

Figure 2:
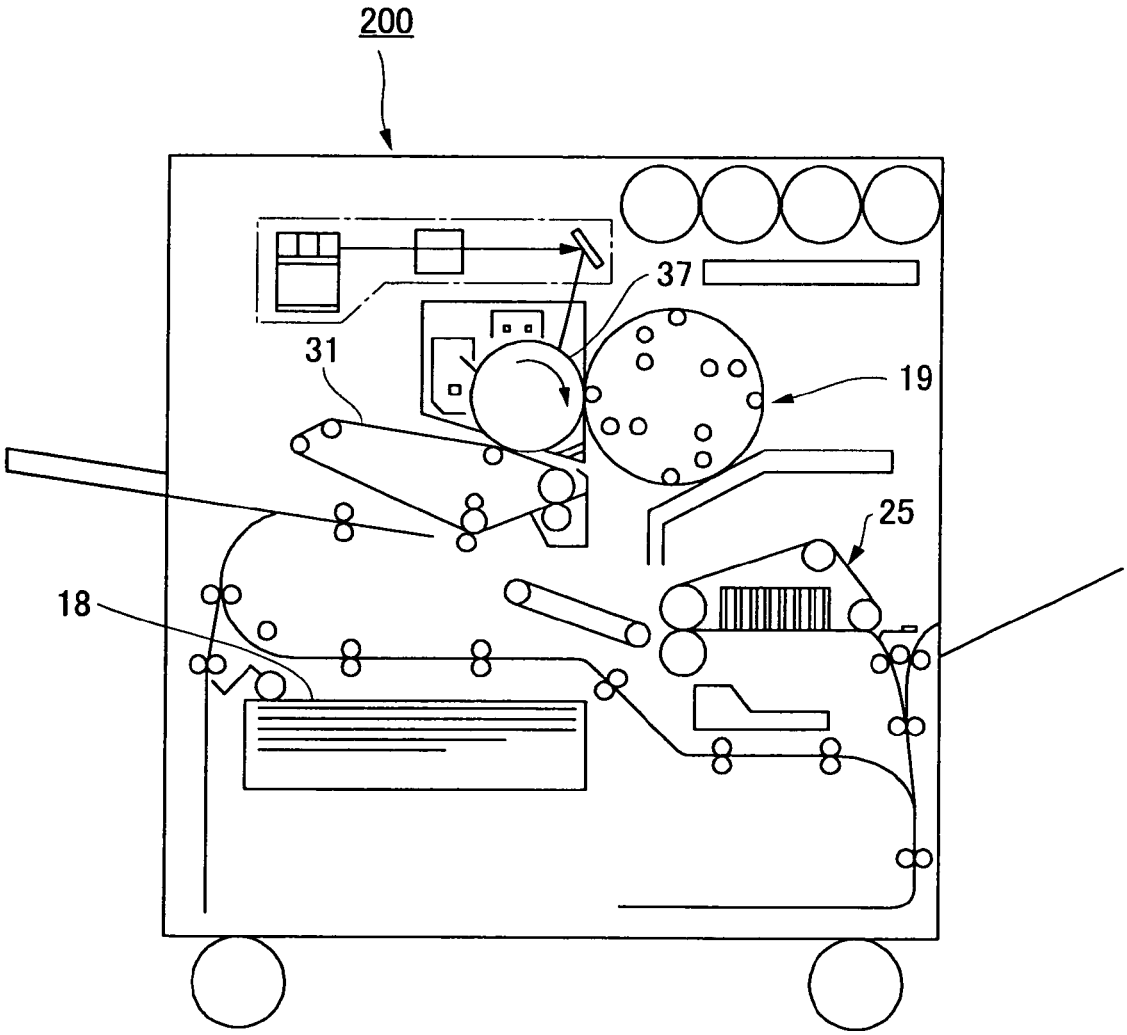
FIG. 2 is a schematic view showing an image forming apparatus according to the present invention.
Figure 3:
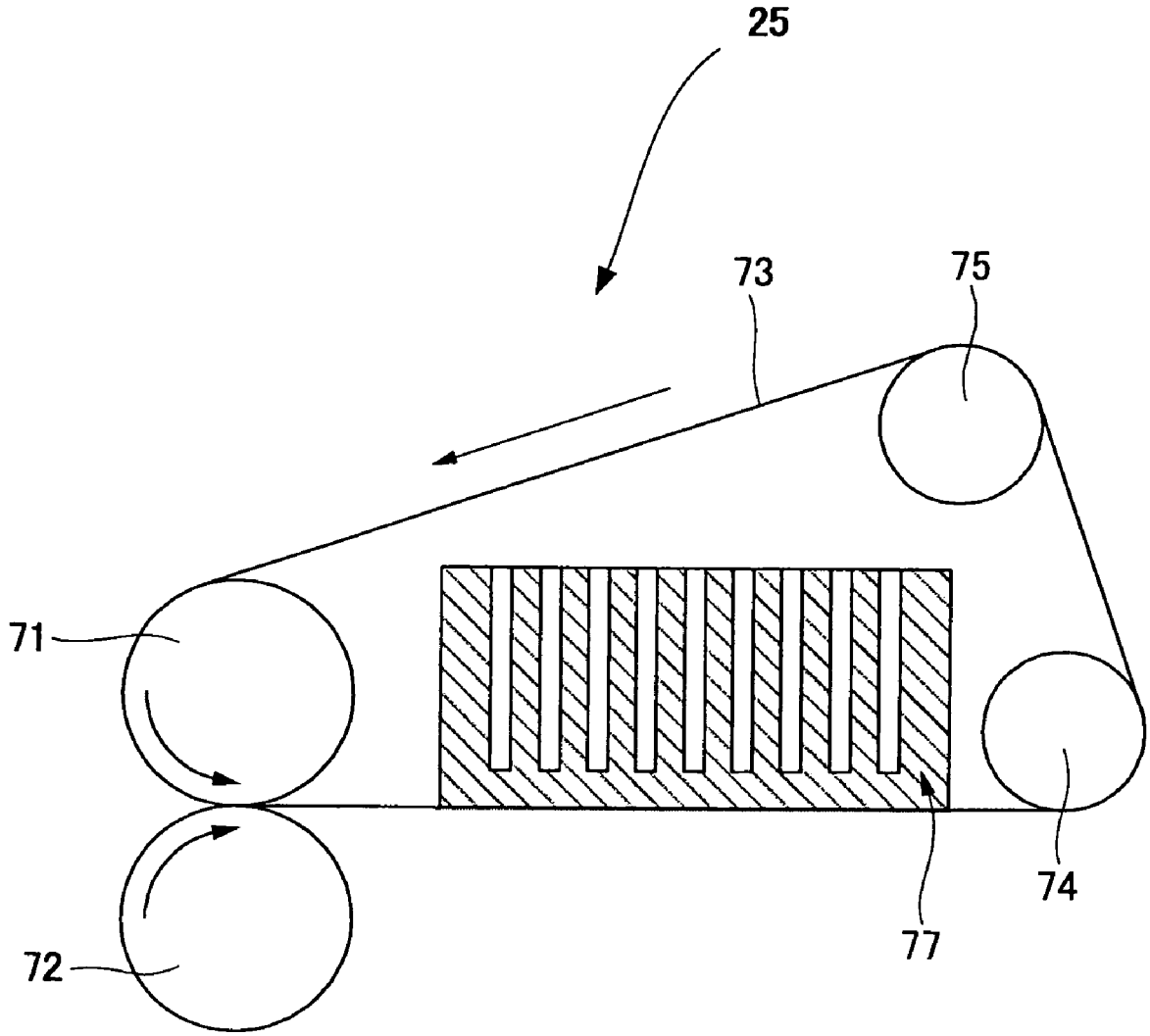
FIG. 3 is a schematic view showing an example of the apparatus configured to fix an image and smooth the image surface in FIG. 2.

An apparatus configured to fix an image and smooth the image surface shown in FIG. 3 can be used in an image forming apparatus (e.g., a full-color laser printer DCC-500 (manufactured and sold by Fuji Xerox Co., Ltd.)) shown in FIG. 2 by converting the image forming apparatus to a part of the belt fixing in the image forming apparatus.

As shown in FIG. 2, an image forming apparatus 200 is equipped with a photoconductive drum 37, a development device 19, an intermediate transfer belt 31, an electrophotographic recording material 18, and a fixing unit or an apparatus configured to fix an image and smooth the image surface 25.

FIG. 3 shows the apparatus configured to fix an image and smooth the image surface 25 or the fixing unit which is arranged inside the image forming apparatus 200 in FIG. 2.

As shown in FIG. 3, the apparatus configured to fix an image and smooth the image surface 25 is equipped with a heat roller 71, a peeling roller 74, a tension roller 75, an endless belt 73 supported rotatably by the tension roller 75 and pressurizing roller 72 contacted by pressure to the heat roller 71 through the endless belt 73.

A cooling heatsink 77 which forces the endless belt 73 to cool is arranged inside the endless belt 73 between the heat roller 71 and the peeling roller 74. The cooling heatsink 77 constitutes a cooling and sheet-conveying unit for cooling and conveying the electrophotographic recording material 18.

In the apparatus configured to fix an image and smooth the image surface 25 as shown in FIG. 3, the electrophotographic recording material 18 bearing a color toner image transferred and fixed on the surface of the electrophotographic recording material 18, is introduced into a press-contacting portion (or nip portion) between the heat roller 71 and the pressurizing roller 72 contacted by pressure to the heat roller 71 through the endless belt 73 such that the color toner image in the image-receiving sheet faces to the heat roller 71, wherein while the electrophotographic recording material passes through the press-contacting portion between the heat roller 71 and the pressurizing roller 72, the color toner image is heated and fused to be fixed on the electrophotographic recording material 18.

Thereafter, the electrophotographic recording material bearing the color toner image fixed in the image-receiving layer of electrophotographic recording material by heating the toner of the color toner image to a temperature of substantially from 120° C. to 130° C. at the press-contacting portion between the heat roller 71 and the pressurizing roller 72 is conveyed by the endless belt 73, while the toner image-receiving layer in the surface of electrophotographic recording material adheres to the surface of the endless belt 73. During the conveyance of the electrophotographic recording material 18, the endless belt 73 is forcedly cooled by the cooling heatsink 77 and the color toner image and the image-receiving layer are cooled and set so that the electrophotographic recording material 18 is peeled from the endless belt 73 by the peeling roller 74 and own stiffness (nerve) of the electrophotographic recording material 18.

The surface of the endless belt 73 after the peeling of the electrophotographic recording material 18 is cleaned by removing a residual toner therefrom using a cleaner (not illustrated in FIG. 3) and prepared for the next step of fixing the image and smoothing the image surface.

According to the image forming process of the present invention, by using an image-receiving sheet for electrophotography of the present invention, a high-quality image which is excellent in curling properties and conveyability can be formed without substantially causing nonuniformity of images, and blisters.

EXAMPLES

Hereafter, the present invention will be further described in detail referring to specific Examples and Comparative Examples, however, the present invention is not limited to the disclosed Examples.

Example 1

Production of Support

A pulp was prepared by beating a LBKP (bleached broadleaf tree kraft pulp) to 340 mL of Canadian Standard Freeness using a conical refiner so that the pulp fiber had an average length of 0.63 mm.

<<Measurement of Degree of Water Retention>>

With respect to the beaten pulp, the degree of water retention was measured by the test method of a degree of water retention defined in the JAPAN TAPPI Paper and Pulp Test Method No. 26. Table 2 shows the measurement results.

Based on the mass of the thus prepared pulp, the following components were added to the pulp so as to be a mixture ratio of 1.0% by mass of cation starch, 0.5% by mass of alkyl ketene dimer (AKD), 0.3% by mass of anion polyacrylic amide (PAM), 5% by mass of titanium dioxide ($TiO_2$), and 3% by mass of sodium carboxy methyl cellulose (CMC). The alkyl ketene dimer contains an alkyl group derived from a fatty acid (mainly from behenic acid). For the sodium carboxy methyl cellulose, a water-swellable sodium carboxy methyl cellulose having an esterification degree of 0.25 and an average particle diameter of 20 μm was used.

The prepared paper material was subjected to a paper making treatment using a long-net paper-making machine to produce a wet paper web having a basis weight of 160 g/m$^2$.

The both surfaces of the obtained wet paper web were sandwiched by two sheets of filter paper to dehydrate the wet paper web using a wet pressing unit, and the dehydrated wet paper web was dried using a cylinder dryer. Thereafter, the thus obtained dried paper was subjected to a calendar treatment using a soft calendar apparatus in which a metal roller whose surface temperature was 250° C. was set on the surface of the raw paper on which an image was to be recorded (right face), and a resin roller whose surface temperature was 40° C. was set on another surface of the raw paper, thereby a raw paper was produced.

<<Measurement of Tensile Strength in Z-Axis Direction>>

The obtained raw paper was measured as to the tensile strength in the Z-axis direction of the raw paper defined in the JAPAN TAPPI Paper and Pulp Test Method No. 18-1.

<<Measurement of Water Content>>

The water content of the raw paper was measured according to JIS P 8127 (a method of measuring a water content using a dryer). Table 2 shows the measurement results.

Next, the surface of the obtained raw paper on which an image was to be recorded (right face) was subjected to a corona discharge treatment, and the right face of the raw paper was coated with a high-density polyethylene (HDPE) having a melting point of 133° C. as a first polymer coating layer (undercoat layer) such that the high-density polyethylene (HDPE) had a thickness of 12 μm, and further coated with a low-density polyethylene (LDPE) as a second polymer coating layer (upper layer) such that the low-density polyethylene (LDPE) had a thickness of 15 μm by a melting double-layer extrusion method using a co-extruder.

In the meanwhile, the back face of the raw paper was subjected to a corona discharge treatment, and the back face of the raw paper was coated with a high-density polyethylene (HDPE) so as to have a thickness of 25 μm by a melting extrusion method to thereby form a polymer coating layer on the back face of the raw paper.

—Preparation of Image-Receiving Sheet for Electrophotography—

Using the obtained support, an image-receiving sheet for electrophotography of Example 1 was prepared according to the following method.

—Dispersion of Titanium Dioxide—

In a vessel, 40.0 g of titanium dioxide (TIPAQUE® A-220, manufactured by Ishihara Industry Co., Ltd.), 2.0 g of polyvinyl alcohol (PVA102, manufactured by KURARAY Co., Ltd.), and 58.0 g of ion exchange water were mixed. The components were dispersed using NBK-2 manufactured by Nippon Seiki Co., Ltd. to prepare a dispersion of titanium dioxide (content of titanium dioxide pigment: 40% by mass).

—Preparation of Coating Solution for Toner Image-Receiving Layer—

In a vessel, 15.5 g of the dispersion of titanium dioxide, 15.0 g of a dispersion of carnauba wax (CELLOZOL 524, manufactured by Chukyo Oils Co., Ltd.), 100.0 g of a water dispersion of polyester resin (solid content: 30% by mass; KZA-7049 manufactured by UNITIKA Ltd.), 2.0 g of a thickener (ALCOX E30, manufactured by Meisei Chemicals), 0.5 g of an anionic surfactant (AOT), and 80 mL of ion exchange water were mixed, and the components were stirred to prepare a coating solution for a toner image-receiving layer.

The obtained coating solution for a toner image-receiving layer had a viscosity of 40 mPa·s and a surface tension of 34 mN/m.

—Preparation of Coating Solution for Back Layer—

In a vessel, 100.0 g of a water dispersion of acrylic resin (solid content: 30% by mass, HIROS XBH-997L, manufactured by SEIKO PMC CORPORATION), 5.0 g of a matting agent (TECHPOPOMER MBX-12, manufactured by SEKISUI PLASTICS CO., LTD.), 10.0 g of a releasing agent (HYDRINE D337, manufactured by Chukyo Oils), 2.0 g of a thickener (CMC), 0.5 g of an anionic surfactant (AOT), and 80 mL of ion exchange water were mixed, and the components were stirred to prepare a coating solution for a back layer.

The obtained coating solution for a back layer had a viscosity of 35 mPa·s and a surface tension of 33 mN/m.

—Coating the Support with Back Layer and Toner Image-Receiving Layer—

The surface of the support on which a toner image-receiving layer was not to be formed (back face) was coated with the coating solution for a back layer using a bar coater such that the dry mass was 9 g/m$^2$ to thereby form a back layer on the back face of the support.

The surface of the support (right face) was coated with the coating solution for a toner image-receiving layer using a bar coater such that the dry mass was 12 g/m$^2$ to thereby form a toner image-receiving layer on the surface of the support. The content of a pigment in the toner image-receiving layer was 5% by mass relative to the thermoplastic resin.

After both surfaces of the support were coated with the coating solution for a back layer and the coating solution for a toner image-receiving layer, respectively, the back layer and the toner image-receiving layer were hot-air dried. In the drying, the dry airflow and the temperature were controlled such that both the back layer and the toner image-receiving layer could be dried within 2 minutes after the application of the solutions for these layers. The dry point was regarded as a point that the coated surface temperature was the same temperature of the wet-bulb temperature of the dry air.

Next, after drying, the support formed with the back layer and the toner image-receiving layer was subjected to a calender treatment using a gloss calender under the conditions where the temperature of the metal roller was maintained at 40° C., and the nip pressure was set at 14.7 kN/cm$^2$ (15 kgf/cm$^2$).

Examples 2 to 10 and Comparative Examples 1 to 5

Preparation of Image-Receiving Sheet for Electrophotography

Respective image-receiving sheets for electrophotography of Examples 2 to 10 and Comparative Examples 1 to 5 were prepared in the same manner as in Example 1 except that the formulation of the raw paper and the polymer coating layer were changed as shown in Tables 2 and 3.

The degree of water retention of the pulp, the tensile strength of a Z-axis direction, and water content of the each of the raw paper were measured in the same manner as in Example 1.

TABLE 2

| | Formulation of Raw Paper | | | | | |
|---|---|---|---|---|---|---|
| | | Sizing agent | | Paper strength improving agent | | |
| | Degree of water retention of Pulp (%) | Component | Content (% by mass) | Component | Content (% by mass) | Filler Component |
| Ex. 1 | 132 | AKD | 0.4 | PAM | 0.3 | $TiO_2$ |
| Ex. 2 | 132 | AKD | 0.4 | PAM | 0.3 | — |
| Ex. 3 | 140 | AKD | 0.4 | PAM | 0.3 | — |
| Ex. 4 | 140 | AKD | 0.4 | PAM | 0.8 | $TiO_2$ |
| Ex. 5 | 132 | AKD | 0.4 | PAM | 0.6 | — |
| Ex. 6 | 140 | EFA | 0.5 | PAM | 0.6 | — |
| Ex. 7 | 151 | EFA | 0.5 | PAM | 0.6 | — |
| Ex. 8 | 151 | EFA | 0.5 | PAM | 0.8 | $CaCO_3$ |
| Ex. 9 | 140 | AKD | 0.4 | PAM | 0.8 | $TiO_2$ |
| Ex. 10 | 140 | AKD | 0.4 | PAM | 0.3 | — |
| Compara. Ex. 1 | 121 | EFA | 0.5 | PAM | 0.3 | $TiO_2$ |
| Compara. Ex. 2 | 121 | EFA | 0.5 | PAM | 0.3 | $TiO_2$ |
| Compara. Ex. 3 | 151 | EFA | 0.3 | PAM | 0.8 | — |
| Compara. Ex. 4 | 160 | AKD | 0.4 | PAM | 0.8 | — |
| Compara. Ex. 5 | 158 | AKD | 0.3 | PAM | 0.8 | — |

| | Formulation of Raw Paper | | | Properties of raw paper | |
|---|---|---|---|---|---|
| | Filler | Fixing agent | | Tensile strength in | |
| | Content (% by mass) | Component | Content (% by mass) | the Z-axis direction (kN/m$^2$) | Moisture content (% by mass) |
| Ex. 1 | 5 | CMC | 3 | 358 | 6.3 |
| Ex. 2 | — | CMC | 2 | 467 | 3.8 |
| Ex. 3 | — | CMC | 2 | 501 | 6.5 |
| Ex. 4 | 3 | CMC | 3 | 523 | 7.1 |
| Ex. 5 | — | CMC | 3 | 520 | 6.8 |

TABLE 2-continued

| | | | | | |
|---|---|---|---|---|---|
| Ex. 6 | — | — | — | 543 | 7.1 |
| Ex. 7 | — | CMC | 5 | 641 | 6.9 |
| Ex. 8 | 8 | CMC | 1 | 567 | 7.7 |
| Ex. 9 | 3 | CMC | 3 | 523 | 7.1 |
| Ex. 10 | — | CMC | 2 | 501 | 6.5 |
| Compara. Ex. 1 | 3 | — | — | 338 | 7.7 |
| Compara. Ex. 2 | 3 | — | — | 338 | 7.1 |
| Compara. Ex. 3 | — | CMC | 2 | 663 | 6.8 |
| Compara. Ex. 4 | — | CMC | 2 | 780 | 7.1 |
| Compara. Ex. 5 | — | — | — | 765 | 3.8 |

In Table 2, AKD means alkyl ketene dimer; EFA means an epoxidized fatty acid amide; PAM means an anionic polyacrylic amide; and CMC means sodium carboxy methyl cellulose.

TABLE 3

| | Polymer coating layer formed on right face of the support | | | | | |
|---|---|---|---|---|---|---|
| | 1st polymer coating layer | | 2nd polymer coating layer | | Polymer coating layer formed on the back face | |
| | Type | Thickness (μm ) | Type | Thickness (μm) | Type | Thickness (μm) |
| Ex. 1 | C | 12 | A | 15 | E | 25 |
| Ex. 2 | C | 12 | B | 15 | E | 25 |
| Ex. 3 | D | 11 | A | 15 | C | 23 |
| Ex. 4 | C | 12 | A | 15 | C | 23 |
| Ex. 5 | A | 5 | C | 20 | E | 25 |
| Ex. 6 | A | 20 | C | 7 | E | 25 |
| Ex. 7 | D | 11 | A | 15 | C | 23 |
| Ex. 8 | D | 11 | A | 15 | C | 23 |
| Ex. 9 | C | 12 | A | 15 | F | 25 |
| Ex. 10 | G | 30 | — | — | C | 25 |
| Compara. Ex. 1 | A | 30 | — | — | C | 23 |
| Compara. Ex. 2 | E | 25 | — | — | E | 25 |
| Compara. Ex. 3 | D | 23 | — | — | E | 25 |
| Compara. Ex. 4 | C | 12 | B | 15 | C | 23 |
| Compara. Ex. 5 | C | 23 | — | — | A | 30 |

In Table 3, A represents a LDPE (melting point: 106° C., density: 0.915 g/cm$^3$); B represents a straight chain low-density polyethylene (LLDPE) (melting point: 115° C., density: 0.922 g/cm$^3$); C represents a HDPE (melting point: 133° C., density: 0.954 g/cm$^3$); D represents a polypropylene (PP) (melting point: 157° C.); E represents a polyethylene composition containing HDPE/LDPE=70/30 (mass ratio) (melting point: 126° C.); F represents a polyethylene composition containing HDPE/LDPE=80/20 (mass ratio) (melting point: 111° C.); and G represents a polyethylene composition containing LDPE/HDPE=1/1 (mass ratio) (melting point: 120° C.).

<Formation of Image>

Each of the obtained image-receiving sheets for electrophotography was cut into an A4 size. The fixing unit of a full-color laser printer ((DCC-500) manufactured and sold by Fuji Xerox Co., Ltd.)) shown in FIG. 2 was remodeled to an apparatus configured to fix an image and smooth the image surface as shown in FIG. 3 and the laser printer was used as an image forming apparatus to form an image on the each of the obtained image-receiving sheets for electrophotography, and fix the image on the each of the image-receiving sheets for electrophotography to smooth the image surface under the following conditions.

—Belt—

Support of the belt: polyimide (PI) film; width of the belt=50 cm; and the thickness of the belt=80 μm Material of the releasing layer of the belt: SIFEL610 (manufactured by Shin-Etsu Chemical Co., Ltd.) being a precursor of fluorocarbon siloxane rubber was vulcanized and cured to form the fluorocarbon siloxane rubber of 50 μm in thickness on the support.

—Heating and Pressurizing—

Temperature of heat roller: arbitrarily and suitably adjustable.

Nip pressure: 130N/cm$^2$

—Cooling—

Cooler: Length of the heatsink=80 mm

Conveying speed=53 mm/sec

Each of the obtained electrophotographic print sheets were evaluated as to image nonuniformity, anti-blister properties, curling properties, and conveyability. Table 4 shows the evaluation results.

<Image Nonuniformity>

The each of the electrophotographic print sheets were visually checked as to image nonuniformity and were evaluated based on the following criteria. An electrophotographic print sheet which was the most excellent i.e. an electrophotographic print sheet having no image nonuniformity was ranked as A, and those subsequently ranked ones were ranked in the order of higher to lowest as B, C, and D.

[Evaluation Criteria]

A . . . Very excellent (usable as a high-quality image recording material)

B . . . Excellent (usable as a high-quality image recording material)

C . . . Slightly degraded compared to the one ranked as B (unusable as a high-quality image recording material)

D . . . Degraded (unusable as a high-quality image recording material)

<Evaluation of Anti-Blister Properties>

With respect to the each of the image-receiving sheets for electrophotography, the temperature of the fixing belt at which blisters due to image-formation started to occur was measured, and the each of the image-receiving sheets for electrophotography was evaluated according to the measured temperature based on the following criteria.

[Evaluation Criteria]

A . . . The temperature at which blisters started to occur was 140° C. or more, and the image-receiving sheet was excellent in anti-blister properties.

B . . . The temperature at which blisters started to occur was 130° C. or more and less than 140° C., and the image-receiving sheet was excellent in anti-blister properties.

C . . . The temperature at which blisters started to occur was 120° C. or more and less than 130° C., and the image-receiving sheet was poor in anti-blister properties.

D . . . The temperature at which blisters started to occur was less than 120° C., and the image-receiving sheet was poor in anti-blister properties.

<Evaluation of Curling Properties>

The each of the image-receiving sheets for electrophotography was cut into a post card size to prepare test samples. The respective test samples were left under the conditions of 20° C. and a relative humidity of 50% for 2 days, and then the curling occurrence of the respective test samples were evaluated based on the following criteria.

A . . . There was no curling at all, and the test sample was very excellent in curling properties.

B . . . Curling did not occur, and the test sample was excellent in curling properties.

C . . . Curling occurred, and the test sample was on the level where it would be problematic in practical use.

D . . . Curled portions were conspicuously observed, and the test sample was on the level where it would be problematic in practical use.

<Evaluation of Conveyability>

With respect to the each of the image-receiving sheets for electrophotography, a running test of printing 50 sheets consecutively was performed twice using the above-noted full-color laser printer (DCC-500) under the same conditions mentioned above to print out 100 sheets in total. The each of the image-receiving sheets for electrophotography was evaluated as to conveyability based on the number of failure sheets caused by conveyance failures such as paper-jamming and conveyed plural paper sheets during conveying of the sheets inside the printer. The evaluation criteria are as follows.

[Evaluation Criteria]

A . . . The number of conveyance failure sheets was zero, and the image-receiving sheet was excellent in conveyability.

B . . . The number of conveyance failure sheets was 1 or 2, and the image-receiving sheet was within the allowable limits.

C . . . The number of conveyance failure sheets was 3 to 10, and the image-receiving sheet was poor in conveyability.

D . . . The number of conveyance failure sheets was 11 or more, and the image-receiving sheet was significantly poor in conveyability.

TABLE 4

| | Image nonuniformity | Anti-blister properties | Curling properties | Conveyability |
|---|---|---|---|---|
| Ex. 1 | A | B | A | A |
| Ex. 2 | A | A | A | B |
| Ex. 3 | A | A | A | A |
| Ex. 4 | A | A | A | A |
| Ex. 5 | B | A | B | A |
| Ex. 6 | B | B | A | A |
| Ex. 7 | B | A | A | A |
| Ex. 8 | A | B | A | A |
| Ex. 9 | A | A | B | A |
| Ex. 10 | B | B | A | A |
| Compara. Ex. 1 | D | D | B | C |
| Compara. Ex. 2 | C | C | C | C |
| Compara. Ex. 3 | C | A | C | A |
| Compara. Ex. 4 | C | A | A | A |
| Compara. Ex. 5 | C | A | C | C |

The evaluation results shown in Tables 1 to 4 exemplified that the image-receiving sheets for electrophotography of Examples 1 to 10 using a raw paper having a tensile strength in the Z-axis direction defined in the JAPAN TAPPI Paper and Pulp Test Method No. 18-1 of 350 kN/m$^2$ to 650 kN/m$^2$ caused fewer occurrences of image nonuniformity and blisters and were excellent in curling properties and conveyability as compared to the image-receiving sheets for electrophotography of Comparative Examples 1 to 5. The evaluation results also show that in particular, the image-receiving sheets for electrophotography of Examples 3 and 4 caused no image nonuniformity as well as caused no blisters and were extremely excellent in curling properties and conveyability.

The image-receiving sheet for electrophotography of the present invention is excellent in curling properties and conveyability without substantially causing nonuniformity of images, and blisters, and thus the image-receiving sheet for electrophotography can be suitably used particularly for electrophotographic printing.

What is claimed is:

1. An image-receiving sheet for electrophotography comprising:

a support, and at least one layer of a toner image-receiving layer disposed on the support, wherein the support comprises a raw paper and at least one layer of a polymer coating layer on both surfaces of the raw paper; and the tensile strength in the Z-axis direction of the raw paper defined in the JAPAN TAPPI Paper and Pulp Test Method No. 18-1 is 350 kN/m$^2$ to 650 kN/m$^2$.

2. The image-receiving sheet for electrophotography according to claim 1, wherein the raw paper has a tensile strength in the Z-axis direction of 400 kN/m$^2$ to 550 kN/m$^2$.

3. The image-receiving sheet for electrophotography according to claim 1, wherein the raw paper has a degree of water retention of pulp of 125% to 155%.

4. The image-receiving sheet for electrophotography according to claim 3, wherein the raw paper has a degree of water retention of pulp of 130% to 145%.

5. The image-receiving sheet for electrophotography according to claim 1, wherein the support comprises at least two layers of right face polymer coating layers formed on the surface of the support on which the toner image-receiving layer is to be formed; and the melting point of the polymer contained in the innermost right face polymer coating layer which is disposed at the nearest from the raw paper is 15° C. or more higher than the melting point of the polymer contained in the outermost right face polymer coating layer which is disposed at the farthest from the raw paper, and is 130° C. or more.

6. The image-receiving sheet for electrophotography according to claim 5, wherein the at least two layers of right face polymer coating layers respectively have a thickness of 5 μm or more.

7. The image-receiving sheet for electrophotography according to claim 6, wherein the at least two layers of right face polymer coating layers respectively have a thickness of 7 μm to 20 μm.

8. The image-receiving sheet for electrophotography according to claim 1, wherein the back face polymer coating layer to be formed on the surface of the support, which is opposite to another surface of the support on which the toner image-receiving layer is to be formed, comprises a polyolefin resin containing a high-density polyethylene having a density of 0.945 g/cm$^3$ or more.

9. The image-receiving sheet for electrophotography according to claim 1, wherein the raw paper has a water content of 4% by mass to 7.5% by mass.

10. The image-receiving sheet for electrophotography according to claim 1, wherein the raw paper comprises a kraft pulp (KP).

11. The image-receiving sheet for electrophotography according to claim 10, wherein the kraft pulp comprises a bleached broad-leaf tree kraft pulp (LBKP).

12. The image-receiving sheet for electrophotography according to claim 1, wherein the raw paper comprises a sizing agent, a paper strength additive, a filler, and a fixing agent.

13. An image forming process comprising:

forming a toner image on a surface of an image-receiving sheet for electrophotography, and fixing the toner image formed in the formation of the toner image on the image-receiving sheet for electrophotography to smooth the surface of the toner image, wherein the image-receiving sheet for electrophotography comprises a support, and at least one layer of a toner image-receiving layer disposed on the support; the support comprises a raw paper and at least one layer of a polymer coating layer on both surfaces of the raw paper; and the tensile strength in the Z-axis direction of the raw paper defined in the JAPAN TAPPI Paper and Pulp Test Method No. 18-1 is 350 kN/m$^2$ to 650 kN/m$^2$.

14. The image forming process according to claim 13, wherein the fixing a toner image to smooth the surface of the toner image comprises heating, pressurizing, cooling the toner image, and peeling the toner image-receiving sheet from a belt using an apparatus configured to fix an image and smooth the image surface which is equipped with a heating and pressurizing member, a belt, and a cooling unit.

15. The image forming process according to claim 14, wherein the belt comprises a belt support and a fluorocarbon siloxane rubber-containing layer formed on a surface of the belt support.

16. The image forming process according to claim 15, wherein the fluorocarbon siloxane rubber in the fluorocarbon siloxane rubber-containing layer comprises, in the main chain thereof, at least any one of a perfluoroalkyl ether group and a perfluoroalkyl group.

17. The image forming process according to claim 14, wherein the belt comprises the belt support, a silicone rubber-containing layer formed on the surface of the belt support, and a fluorocarbon siloxane rubber-containing layer formed on the surface of the silicone rubber-containing layer.

* * * * *